US006144832A

United States Patent [19]

Nimura et al.

[11] Patent Number: 6,144,832

[45] Date of Patent: Nov. 7, 2000

[54] NO WRINKLING SHEET FEEDING APPARATUS, A FIXING APPARATUS AND AN IMAGE FORMING APPARATUS

[75] Inventors: Shigeaki Nimura, Chiba; Kazuhito Kishi, Yokohama, both of Japan

[73] Assignee: Ricoh Company, Ltd., Tokyo, Japan

[21] Appl. No.: 09/145,418

[22] Filed: Sep. 1, 1998

[30] Foreign Application Priority Data

| | | | |
|---|---|---|---|
| Sep. 1, 1997 | [JP] | Japan | 9-235934 |
| Dec. 9, 1997 | [JP] | Japan | 9-338424 |
| Dec. 10, 1997 | [JP] | Japan | 9-339792 |

[51] Int. Cl.[7] ..... G03G 15/20

[52] U.S. Cl. ..... 399/328; 271/119; 399/330; 399/331; 399/333

[58] Field of Search ..... 399/330, 328, 399/331, 333, 324, 325, 329, 122; 219/216; 271/271, 109, 119; 492/28, 30, 40

[56] References Cited

U.S. PATENT DOCUMENTS

| | | | |
|---|---|---|---|
| 4,288,067 | 9/1981 | Vigano' | 492/28 |
| 4,430,412 | 2/1984 | Miwa et al. | 430/126 |
| 4,646,677 | 3/1987 | Lounsbury, Jr. et al. | 399/119 |
| 5,070,231 | 12/1991 | Bacus et al. | 219/216 |
| 5,262,834 | 11/1993 | Kusaka et al. | 399/329 |
| 5,267,008 | 11/1993 | Rebres et al. | 492/30 |
| 5,532,808 | 7/1996 | Saito et al. | 399/333 |
| 5,572,291 | 11/1996 | Moriguchi et al. | 399/390 |
| 5,697,036 | 12/1997 | Moser | 399/329 |
| 5,732,316 | 3/1998 | Yamasaki et al. | 399/321 |
| 5,753,348 | 5/1998 | Hatakeyama et al. | 399/122 |
| 5,778,294 | 7/1998 | Hiraoka et al. | 399/329 |
| 5,854,465 | 12/1998 | Kishi et al. | 219/216 |

FOREIGN PATENT DOCUMENTS

| | | |
|---|---|---|
| 9-171297 | 6/1997 | Japan . |
| 9-271813 | 10/1997 | Japan . |

*Primary Examiner*—Quana Grainger

*Attorney, Agent, or Firm*—Oblon, Spivak, McClelland, Maier & Neustadt, P.C.

[57] ABSTRACT

A fixing apparatus includes a heating roller having a heat source, a pressure roller in pressure contact with the heating roller, a sheet transporting member which transports the sheet between the heating roller and the pressure roller. The pressure roller has a plurality of areas having different traction coefficients on the surface thereof along the width thereof. The area is preferably disposed symmetrically on the surface of the pressure roller.

34 Claims, 28 Drawing Sheets

NO WRINKLING SHEET FEEDING APPARATUS, A FIXING APPARATUS AND AN IMAGE FORMING APPARATUS

BACKGROUND OF THE INVENTION

1. Field of the Invention

The present invention relates to an image forming apparatus, for example copiers, facsimile machines, printers and so on, in particular, to a sheet feeding apparatus capable of feeding a sheet without wrinkling thereof.

2. Description of the Related Art

In a conventional sheet feeding apparatus, wrinkling of to sheet, which generally occurs when to sheet is fed by a heating roller having a heater therein and a pressure roller in pressure contact with the heating roller, is a common problem. To solve such a problem, as illustrated in Japanese Patent application Laid Open No. 05-40428, a heating roller which is driven by a motor and has a larger diameter at both edge portions relative to a center portion, and a pressure roller which has a equal diameter along an axis thereof and is in pressure contact with the heating roller are used. In such a conventional sheet feeding apparatus, both side edge portions of the sheet are fed faster than the center portion due to a strong pressure applied to the sheet at the edges, and, accordingly, the sheet is expanded toward both edges from the center thereof, thereby avoiding some wrinkling thereof.

However, in the conventional sheet feeding apparatus, the pressure roller must be precisely manufactured with a clearance of only 1/100 mm to avoid the above described wrinkling of the sheet. As a result, a manufacturing cost thereof tends to be high.

SUMMARY OF THE PRESENT INVENTION

Accordingly, an improved fixing apparatus for a sheet feeding apparatus of the present invention comprises a heating roller having a heat source therein, a pressure roller in pressure contact with the heating roller and a sheet transporting member which transports the sheet through the heating roller and pressure roller. Furthermore, a surface of the pressure roller has one or more different traction coefficient areas along a width thereof.

In particular, the pressure roller has a higher traction coefficient area at a center portion of the surface thereof, relative to the edges. The fixing apparatus further comprises an endless belt which fixes a toner image onto a copysheet, a heat roller having a heat source therein which winds the endless belt therearound and applies heat thereto, a tension roller which winds the endless belt therearound and applies a tension thereto and a pressure roller disposed in pressure contact with the endless belt against the heat roller, wherein, a high traction coefficient area is formed on a center of the surface of the pressure roller along the width thereof.

Additionally, the pressure roller of the improved fixing apparatus has a surface on which traction coefficient varies so as to decrease from the center of the surface to the both sides edges thereof.

Alternatively, the improved fixing apparatus comprises a pressure roller including one or more high traction coefficient areas each symmetrically disposed along the width of the pressure roller on the surface thereof.

Optionally, the improved fixing apparatus comprises a pressure roller including a plurality of scratches having a predetermined length, depth and width formed on the surface, intermittently along the width and around the circumferencial surface of the roller, at intervals of less than 3 mm.

Also optionally, the improved fixing apparatus comprises a pressure roller including a plurality of pairs of high and low traction coefficient areas, each neighbors to the other and formed along the width of the pressure roller.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENT OF THE PRESENT INVENTION

Figure 1:
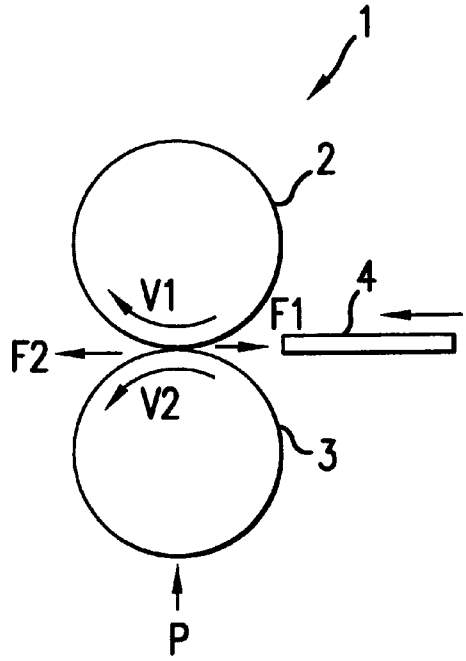
FIG. 1 is a cross sectional view of a conventional fixing apparatus.

Hereinbelow, a plurality of embodiments of the present invention are explained referring to the several drawings. A sheet-feeding apparatus according to one of the embodiments of the present invention is illustrated in FIG. 1. As shown in FIG. 1, the sheet feeding apparatus 1 includes a driving roller 2 and a follower roller 3 driven by the driving roller 2 via a pressure P. The sheet-feeding apparatus is used in an image forming apparatus for example, copiers and so on, to feed a sheet 4, which may be a printing sheet for example. The driving roller 2 is driven by a motor (not shown) and rotates the follower roller 3 by pressure contact with the driving roller 2. To compare a peripheral speed of the drive roller 2 v1 and that v2 of the follower roller 3 in a condition where the follower roller is driven by the drive roller 2, v2 is slightly lower than v1, since a small amount of driving force to be transmitted from the driving roller 2 to the follower roller 3 is lost during transmission therebetween, due to a slip which unavoidably occurs between the both rollers 2 and 3. Accordingly, a friction appears therebetween due to a difference in peripheral speeds. Such a friction is called "a traction force" F1 as shown in FIG. 1 and is applied to the driving roller 2 at a nip portion thereof in a direction of a tangent line of an outer surface thereof so as to reduce it's peripheral speed v1 when the copysheet is fed through the nip portion. Correspondingly, a reverse traction force F2 having a sane amount as the traction force F1 is applied to the follower roller 3 in a direction opposite to that of the traction force F1. Traction coefficient $\mu t$ is obtained by dividing the traction force F by the pressure force P.

The traction coefficient $\mu t$ can also be obtained as a function of so-called sliding ratio between surfaces of the rollers 2 and 3 which is obtained by the formula "dV/V=(V1−V2)/V1. Thus, if the sliding ratio dV/V is relatively small, the traction coefficient $\mu t$ obtained in a dry friction condition is in proportion thereto. To the contrary, if both of the peripheral speed of the rollers 2 and 3 largely differ, the traction coefficient $\mu t$ partly varies on an asymptotic line.

Figure 2:
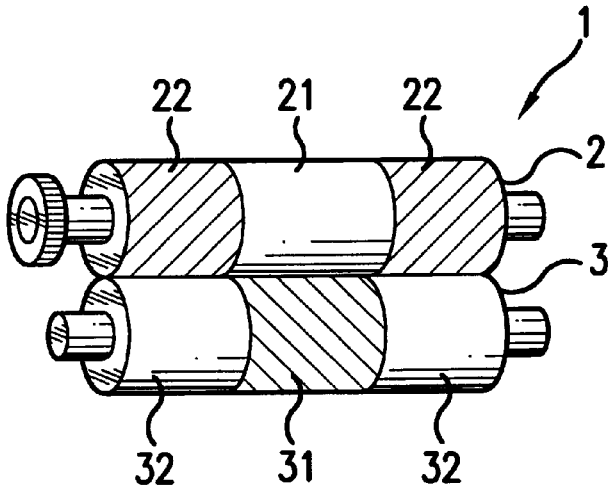
FIG. 2 is a perspective view illustrating surface condition of both a driving roller and follower roller of a first embodiment of the present invention.
Figure 3:
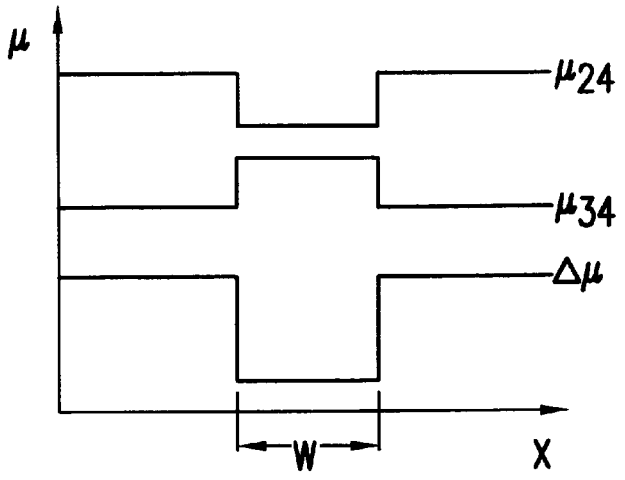
FIG. 3 is a graph illustrating a pair of distributions of traction coefficients of the surfaces of the driving roller and follower roller as illustrated in FIG. 2, along the width thereof.

As illustrated in FIG. 2, a surface of a central portion 21 of the driving roller 2 is smooth, and surfaces of both side portions 22 are rough, so that traction coefficient (or friction coefficient) $\mu$24 is smaller at a central portion of the graph as illustrated in FIG. 3. To the contrary, a central portion 31 of a surface of the follower roller 3 is made rough and both side portions 32 thereof are made smooth so that traction coefficient (or friction coefficient) $\mu$34 between the surface thereof and a sheet 4 is larger at a central portion of the graph thereof as illustrated in FIG. 3. Thus, a difference $\Delta\mu$ of coefficients $\mu$24 and $\mu$34 is made smaller at a central portion relative to both side portions thereof, as illustrated in FIG. 3.

As a result, both side portions of the sheet 4, each of which corresponds to a portion where the difference of $\Delta\mu$ are smaller, are fed faster than a central portion thereof which corresponds to a portion where the difference $\Delta\mu$ is relatively larger as illustrated in FIG. 3. This is because, when the driving roller feeds the sheet 4 by a force f1, the follower roller 3 prevents the copysheet 4 to be fed by a force f2. A relationship between the forces f1 and f2 varies depending upon the difference $\Delta\mu$, and accordingly a feeding speed of the sheet 4 varies depending upon the relationship. Thus, if $\Delta\mu$ is smaller at a portion, $\mu$34 becomes relatively large at the portion compared to $\mu$24 as illustrated in FIG. 3, and a sheet feeding speed is therefore slow, since f2 is almost as large as f1 and accordingly the follower roller 3 prevents the driving roller 2 from feeding sheet 4 quickly.

To the contrary, if $\Delta\mu$ is large at a portion, $\mu$34 becomes relatively small at the portion compared to $\mu$24 as illustrated in FIG. 3, and a sheet feeding speed is therefore faster, since f2 is substantially smaller than f1, and accordingly the follower roller 3 does not largely inhibit the driving roller 2 from feeding sheet 4. Therefore, a sheet feeding speed varies along the width of the copysheet 4. Thus, if a sheet feeding speed of the both side portions of the sheet 4 is faster than that of the central portion, sheet wrinkling is avoided since an expanding force is made by a difference in the feeding speeds of sheet 4.

Figure 5:
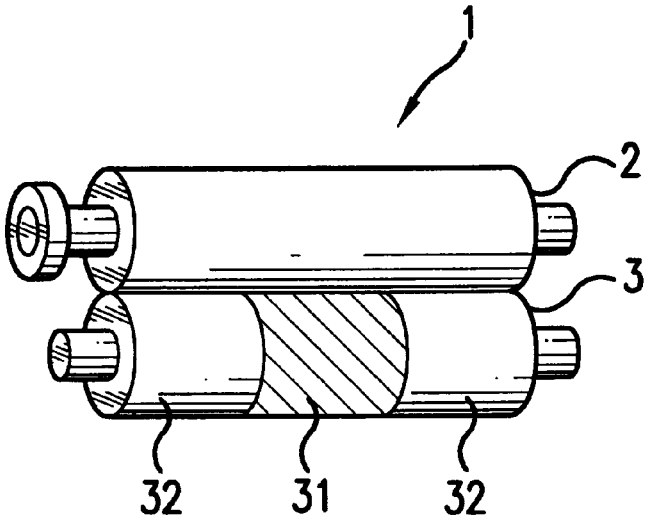
FIG. 5 is a perspective view illustrating surface conditions of both a driving roller and follower roller of a modification of the embodiment as illustrated in FIG. 2.
Figure 6:
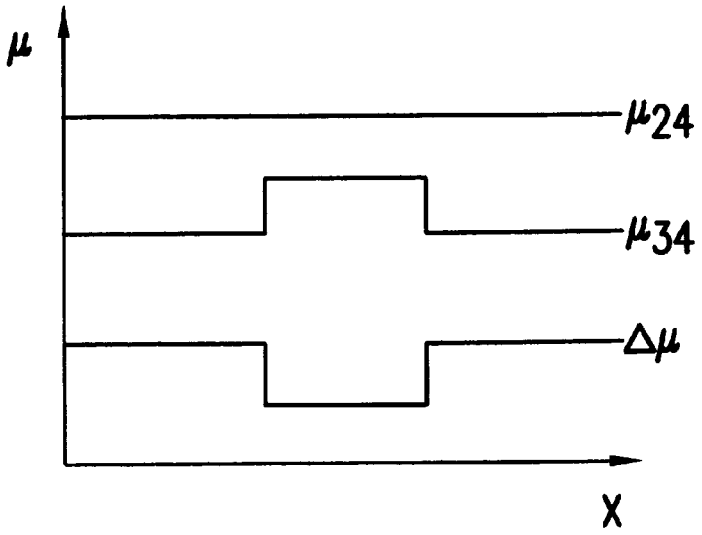
FIG. 6 is a graph illustrating a pair of distributions of traction coefficients of surfaces of the driving roller and follower roller as illustrated in FIG. 5 along the width thereof.

Instead of using the above-described driving roller 2 and follower roller 3, a driving roller having a surface substantially uniform along its width and a follower roller having a rough central portion on its surface and smooth side portions can be used as illustrated in FIG. 5. The same result is obtained since the above described $\Delta\mu$ is smaller at the central portion thereof as illustrated in FIG. 6.

Figure 7:
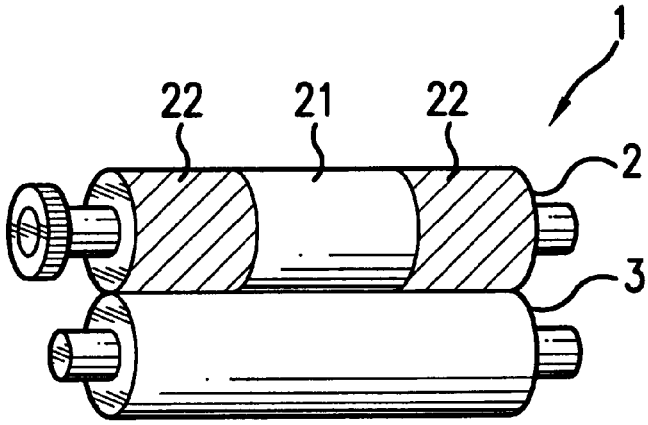
FIG. 7 is a perspective view illustrating surface conditions of both a driving roller and follower roller of still another modification of the embodiment as illustrated in FIG. 2.
Figure 8:
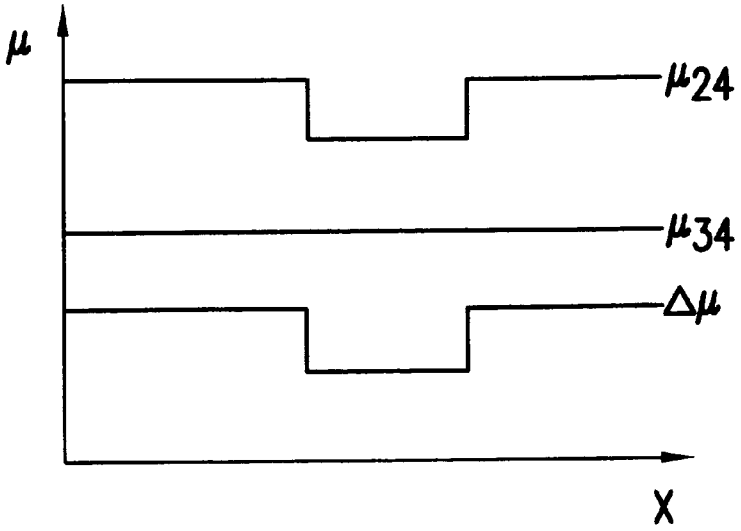
FIG. 8 is a graph illustrating a pair of distributions of traction coefficients of surfaces of the driving roller and follower roller as illustrated in FIG. 7 along the width thereof.

Further, as shown in FIG. 7, a follower roller 3 entirely smooth surface along a width thereof and a driving roller 2 having rough surfaces at both side-portions thereof can be utilized. The same result is obtained, since the above described $\Delta\mu$ is smaller at the central portion thereof as illustrated in FIG. 8. If roller 2 or 3 is smooth, the manufacturing is simplified and steps thereof are minimized.

Instead of varying smoothness of the surfaces of the rollers 2 and 3, the desired $\Delta\mu$ can be obtained by employing different materials which inherently have different friction coefficients. The different materials can be disposed at a central portion and both sides portions of surfaces of the rollers 2 and/or 3.

Figure 9:
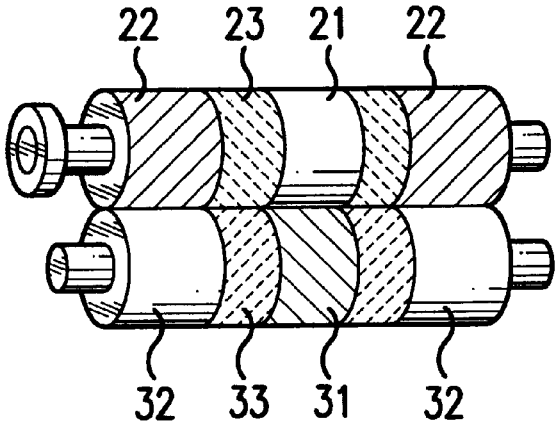
FIG. 9 is a perspective view illustrating surface conditions of both a driving roller and follower roller of still another modification of the embodiment as illustrated in FIG. 2.

Hereinbelow, modifications of the above-described rollers 2 and 3 are explained. As illustrated in FIG. 9, plural kinds of roughened areas are disposed on the surfaces of the rollers 2 and 3 to differentiate roughness of the surfaces along the widths of the rollers 2 and 3. For example, a central portion 21 of the surface of the driving roller 2 is smooth, and both sides portions 22 thereof are relatively rough. Furthermore, portions 23, between the side portions 22 and the central portion 21, are less rough than the side portions 22.

Figure 10:
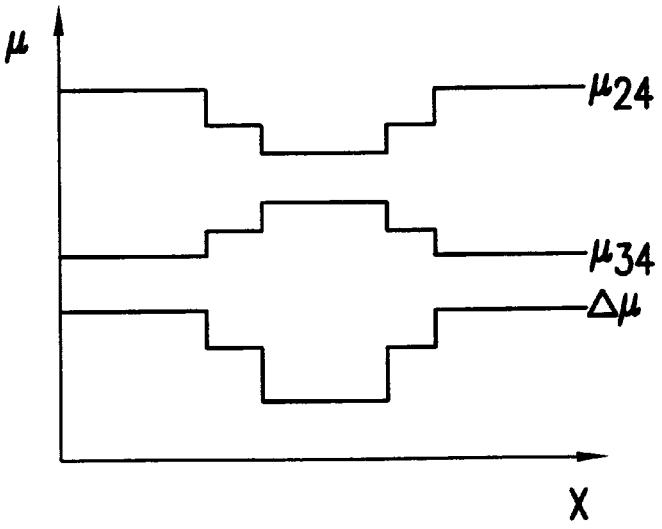
FIG. 10 is a graph illustrating a pair of distributions of traction coefficients of surfaces of the driving roller and follower roller as illustrated in FIG. 9 along the width thereof.

To the contrary, a central portion 31 of the surface of the follower roller 3 is made rough, and both sides portions 32 thereof are made smooth. Furthermore, portions 33 between the side portions 32 and the central portion 31 are less rough than the side portions 32. Thus, as shown in FIG. 10, the above described $\Delta\mu$ varies stepwise at two levels between the central portion and the both side portions. Accordingly, a sheet feeding speed does not sharply change at every portion along the width thereof. Therefore, wrinkling or curling is avoided even when feeding a thin sheet, since a large stress is not imparted onto the copysheet 4.

Figure 11:
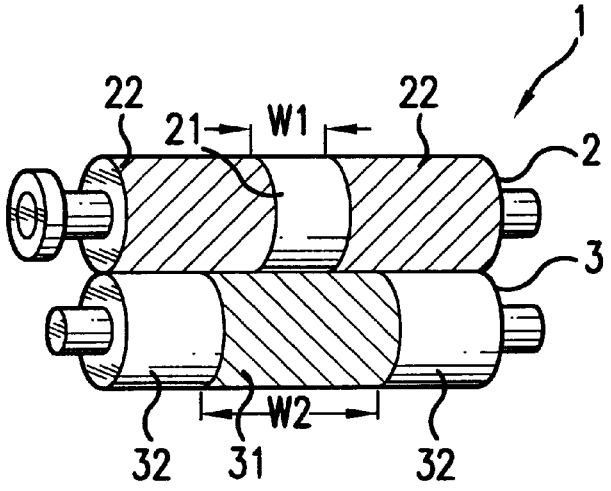
FIG. 11 is a perspective view illustrating surface conditions of both a driving roller and follower roller of still another modification of the embodiment as illustrated in FIG. 2.
Figure 12:
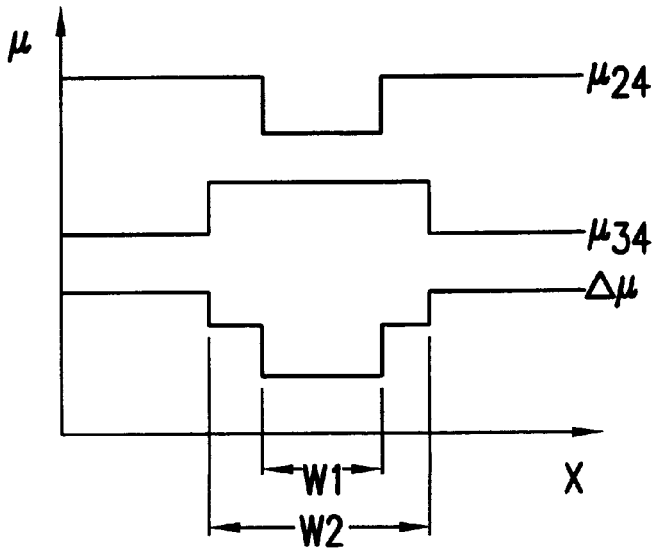
FIG. 12 is a graph illustrating a pair of distributions of traction coefficients of surfaces of the driving roller and follower roller as illustrated in FIG. 11 along the width thereof.

Further, as illustrated in FIG. 11, only a central portion 21 having a width W1 of the driving roller 2 may be made smooth, and a central portion 31 having a width w2 of the follower roller 3 which is different from the width W1 can be made rough to obtain the above described $\Delta\mu$, as illustrated in FIG. 12.

Figure 13:
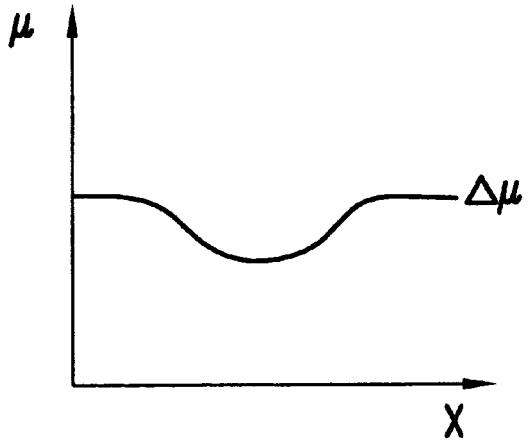
FIG. 13 is a graph illustrating a distribution of traction coefficients of the surface of the follower roller of still another modification of the embodiment as illustrated in FIG. 2 along the width thereof.

If the roughness of the surfaces of the rollers 2 and/or 3 is changed along the width thereof with a very small pitch, a curvature of the $\Delta\mu$ smoothly varies in a state as illustrated in FIG. 13. Further, if the above-described rollers 2 and 3 are used as a fixing device of an image forming apparatus, for example, and a copysheet 4 having a fixed toner image 5 thereon at a central portion of one side surface thereof which faces a follower roller 3 are fed therethrough, a surface of the toner image area 5 becomes smoother than portions of non-toner area 6 of the copysheet 4.

Figure 14:
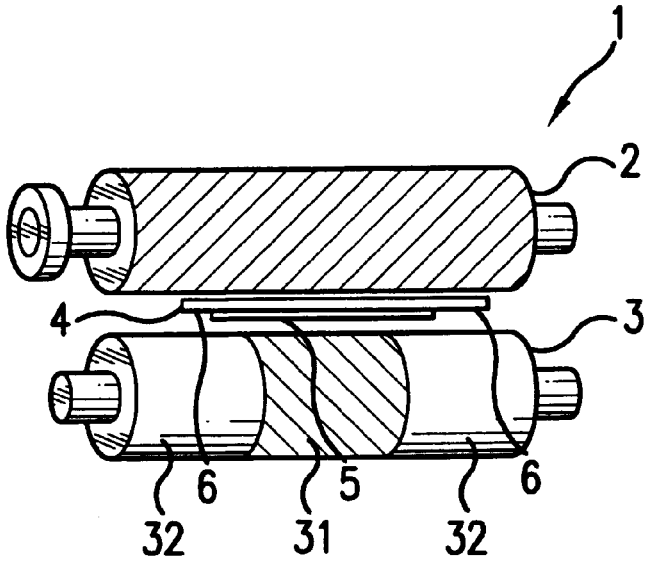
FIG. 14 is a perspective view illustrating surface conditions of both a driving roller and follower roller of still another modification of the embodiment as illustrated in FIG. 2.
Figure 15:
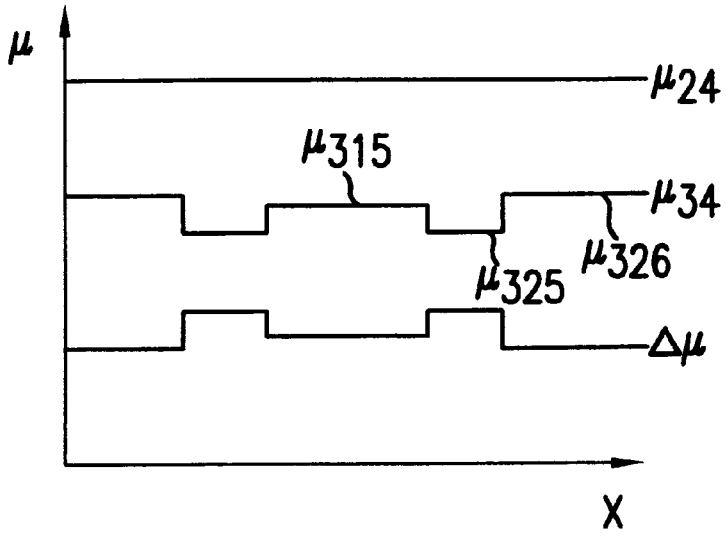
FIG. 15 is a graph illustrating a pair of distributions of traction coefficients of surfaces of the driving roller and follower roller of the still another modification along the width thereof, which appears when a copysheet having a toner image thereon passes through a nip between the driving roller and follower roller.

In such a fixing apparatus, if a surface of the driving roller 2 is evenly made along a width thereof and a surface of the central portion 31 of the follower roller 3 is made rough and both side portions 32 thereof are made relatively smooth as illustrated in FIG. 14, both traction coefficients $\mu$315 between the central portion 31 and the toner image area 5, and $\mu$325 between the side portions 32 and the toner image area 5 become small as illustrated in FIG. 15. If the $\mu$315 becomes smaller than a predetermined level, $\Delta\mu$ of a central portion of the sheet 4 becomes larger than both sides thereof as shown in FIG. 15 (bottom), thereby both side portions of the sheet can be fed faster than the central portion thereof. Accordingly, the wrinkling occurs thereon.

Figure 16:
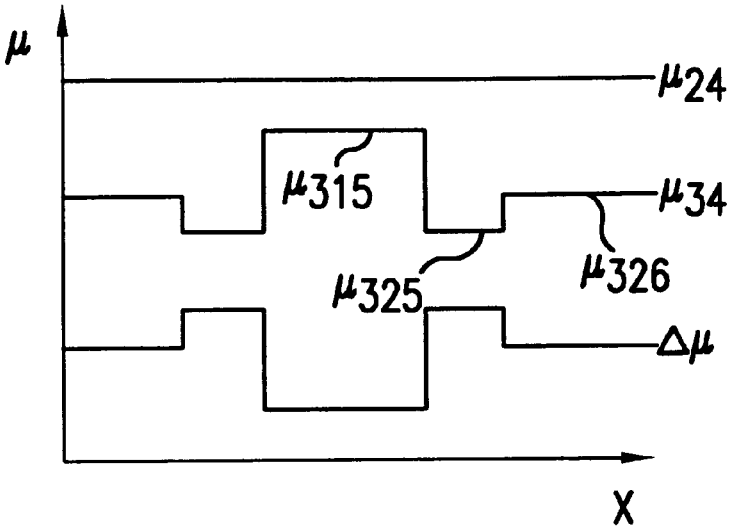
FIG. 16 is a graph illustrating a pair of distributions of traction coefficients of surfaces of the driving roller and follower roller along the width thereof of the another modification.

To avoid such a problem, as shown in FIG. 16, a roughness of the central portion 31 of the follower roller 3 is provided at a predetermined level that a difference of $\mu$315 and $\mu$325 is larger than a difference of the $\mu$326, which is obtained as a traction coefficient between the both side portions 32 and the non toner image area 6 of the sheet 4, and the $\mu$325. Thus, since the both side portions of the copysheet 4 having the toner image thereon can be fed faster than the central portion thereof, wrinkling does not appears thereon.

Figure 4:
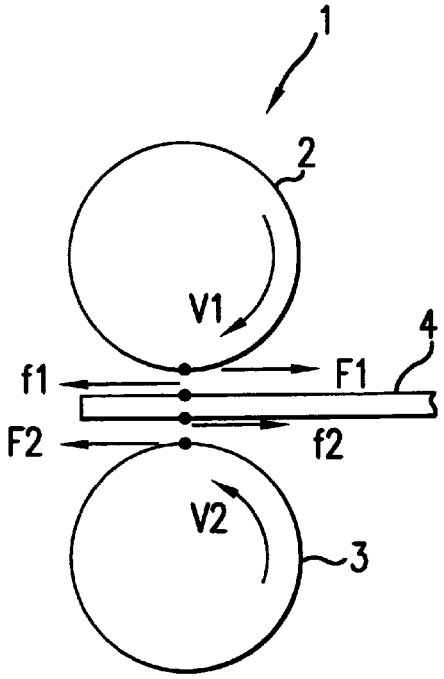
FIG. 4 is a cross sectional view of the driving roller and follower roller illustrating relations of forces generated among the driving roller, the follower roller and a copysheet.

According to an experiment, below described facts are realized. As a first experiment, whether an OHP sheet or copysheet wrinkles was researched using a sheet feeding apparatus 1 as a fixing apparatus of an image forming apparatus as illustrated in FIG. 4. The driving roller 2 may be made of aluminum, steel or other alloy manufactured in a form of a cylinder and includes a halogen type heater therein. The driving roller 2 had a smooth outer layer of fluorine having thickness of from 10 to 30 $\mu$mm and having a character of repelling toner used in the image forming apparatus. The follower roller 3 was made of a metal a core made of a steel for example, and an elastic material layer having a heat-proof characteristic, a silicon rubber layer for example, mounted on the core. A central portion of the surface of the driving roller 2 was made relatively more smooth to obtain a coefficient $\Delta\mu$ at the central portion of the sheet 4 by about 0.6 less than both side portions thereof. When a blank sheet 4 was fed by the rollers 2 and 3 which were heated at about 150° C., no wrinkling occured thereon. On the other hand, when rollers 2 and 3 with a $\Delta\mu$ which does not vary along the width thereof is used, 80% of blank sheets fed by the rollers 2 and 3 were wrinkled.

As a second experiment, whether copysheets having toner images at approximately a center portion thereon wrinkle was researched using a follower roller 3, with a center portion of 21 that was roughened so as to obtain the above-described coefficient $\Delta\mu$ at the center of the copysheet larger than that of side portions thereof by about 1.0 point.

None of the copysheets wrinkled when the above-described rollers 2 and 3 fed ten copysheets. Further, when the above described difference of coefficients $\Delta\mu$ of the central portion was about 0.6 smaller, almost all of copysheets wrinkled at approximately the center of each of trailing edges thereof.

Further, when a hundred thin copysheets having no toner image thereon were fed by the above-described feeding device as used in the first experiment, about 20% thereof wrinkled, resulting in a wave appearing on each of the copysheets 4 after it entered into the rollers 2 and 3. However, when the above-described difference in coefficients $\Delta\mu$ at the center is lowered from a about 0.6 to about 1.0 step by step, none of copysheets 4 wrinkled. A feeding belt wound by a plurality of winding rollers can be used for the driving roller 2 and/or follower roller 3.

Figure 17:
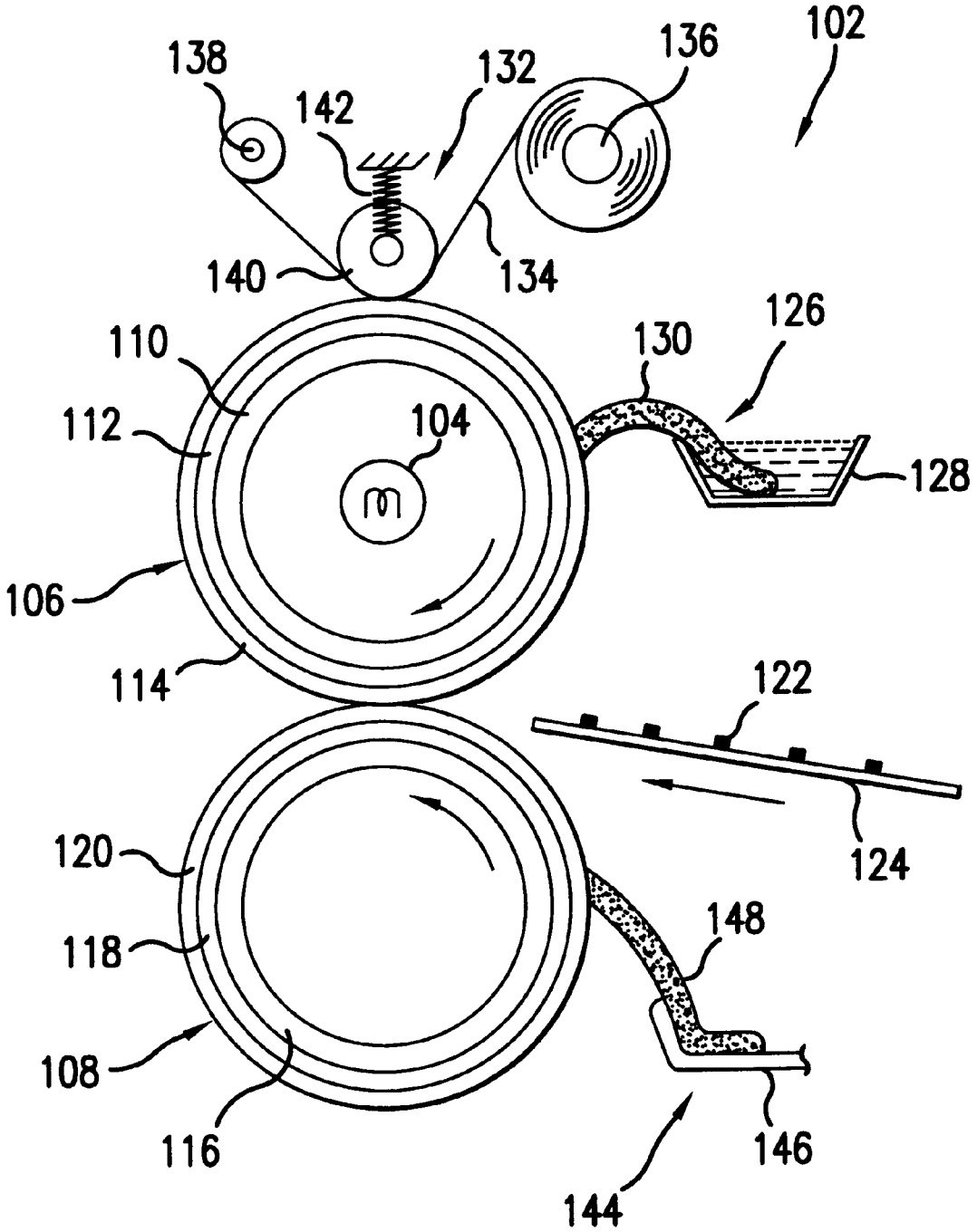
FIG. 17 is a cross sectional view of the fixing device of a second embodiment of the present invention.

Hereinbelow, the second embodiment of the present invention is explained. As shown in FIG. 17, a fixing device 102 is illustrated. The fixing device 102 includes a heating roller 106 having a halogen heater 104 as a heating source therein and a pressure roller 108 which is rotatably disposed in parallel to the heating roller 106 and in pressure contact thereto, at least when a fixing of a copysheet is executed. Both rollers 106 and 107 are made in a form of a straight cylindrical shape. The heating roller 106 is constituted by a core material 110 made of aluminum, an elastic material 112 made of silicon rubber having heat-resistance covering a surface of the core material 110 and a surface layer 114 which repels toner coated around a surface of the elastic material 112.

The same material and same structure to that of the heating roller 106 constitute the pressure roller 108. The heating roller 106 receives a driving force from a driving motor (not shown) and is driven in a direction as shown by an arrow as illustrated in FIG. 17. The pressure roller 108 is driven by the heating roller 106 in a direction as shown by an arrow as illustrated in FIG. 17. A toner image 122 carried on the copysheet 124 is fixed thereto when the copysheet 124 is fed by both of the rollers 106 and 108 which are in pressure contacting each other.

In this embodiment, a copysheet having no toner image on a backside surface thereof, a toner image fixed onto a backside surface thereof or a color toner image fixed thereto can be used. Further, an OHP (over head projector) sheet can be used. Infrared rays can alternatively be used as the heat source of the heating roller 106 for the halogen heater 104. Alternatively, a resistance heater, such as a self-heat-generating type heater or the like, which can evenly heat the heating roller 106 with a predetermined range of temperature along with a width thereof, can be used in a body for the heating roller 106. Materials such as steel, stainless steel, nickel, alloys and ceramics can be used for the core materials 100 and 116 of both rollers 106 and 108.

The elastic layers 112 and 118 can be omitted, if desired. Outermost layer of the materials 114 and 120 which repels toner can be made of silicon rubber. As shown in FIG. 17, a material applying member 126 for applying a material which repels toner is disposed adjoining the heating roller 106. The material-applying member 126 applies the material onto a surface of the heating roller 106 to avoid a toner offset to occur thereon.

Further, a roller cleaning member 132 is disposed adjacent to the heat roller 106 upstream of the material applying member 126 to wipe off-set toner which rarely occurs on the surface of the heating roller 106. Silicon oil, which repels toner, is employed as the material in this embodiment. The material applying member 126 comprises an oil tank 128 capable of containing the silicon oil therein and a felt member 130 capable of absorbing the silicon oil therein and applying the same onto the surface of the heating roller 106.

The roller cleaning member 132 comprises a web feeding roller 136 capable of winding a web roll therearound, a web winding roller 138 which winds the web fed from the web feeding roller 136 therearound, a web pressure roller 140 which contacts the web and a web bias member 142 which biases the pressure roller 140 to press the web against the heating roller 106. A roller capable of applying such silicon oil can be employed for the felt type web 130.

Further, a material collecting member 144 which collects the toner repelling material transferred from the heating roller 106 is arranged such that a leading edge thereof contacts the pressure roller 108. The release agent material collecting member 144 comprises a rubber blade 148 one edge portion of which contacts the surface of the pressure roller 106 and a supporting frame 146 mounted on the body of the fixing device 102 which supports another edge portion thereof. Either a felt or a roller can be substituted for the rubber blade 148 to provide the same function.

Figure 18:
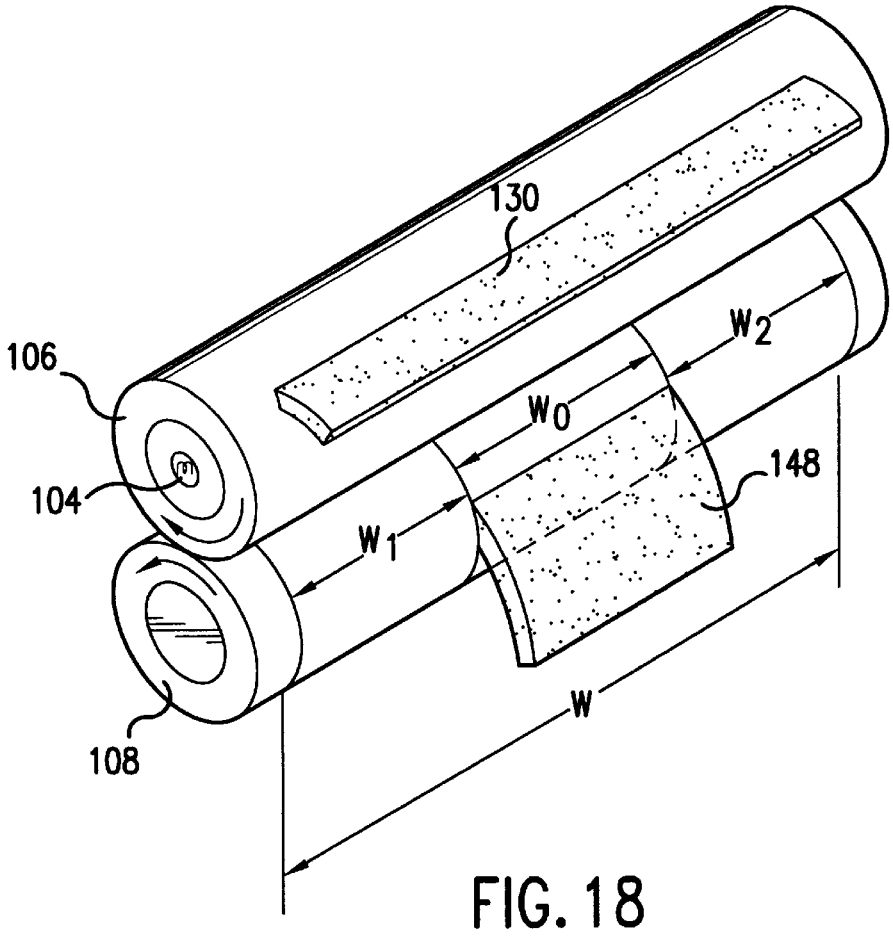
FIG. 18 a perspective view of the fixing device as illustrated in FIG. 17 and a release agent applying member of one of the embodiments of the present invention.

As shown in FIG. 18, the rubber blade 148 contacts an area W0, which is a part of an area W having the width of 300 mm, for example. A widest copysheet passes through the area W when fixed and the felt member 130 correspondingly has the same width to that of the material-applying member 126. Such an area W0 is disposed at an almost center of the width of the pressure roller 108 and has a width of 100 mm, for example. Thus, some amount of the silicon oil evenly applied onto the surface of the pressure roller 108 having the width of W via the heating roller 106 from the oil applying member 126 is collected by the rubber blade 148, only from the central portion thereof over the width W0. Accordingly, the traction coefficient of the center is higher than other portions of the surfaces W1 and W2 of the pressure roller 108, since silicon oil transferred onto the other surfaces is not collected.

According to an experiment, the coefficient of the center W0 is higher by 0.5 than the others. As a result, since a feeding speed of the copysheet 124 fed by the fixing device 102 becomes higher at both side portions thereof, each of which corresponds to the surfaces W1 and W2, and lower at the center thereof, the copysheet 124 receives a tension from the rollers 106 and 108 so that the copysheet 124 is expanded toward both side thereof. Thus, wrinkling of the copysheet 124 can be avoided.

Figure 19:
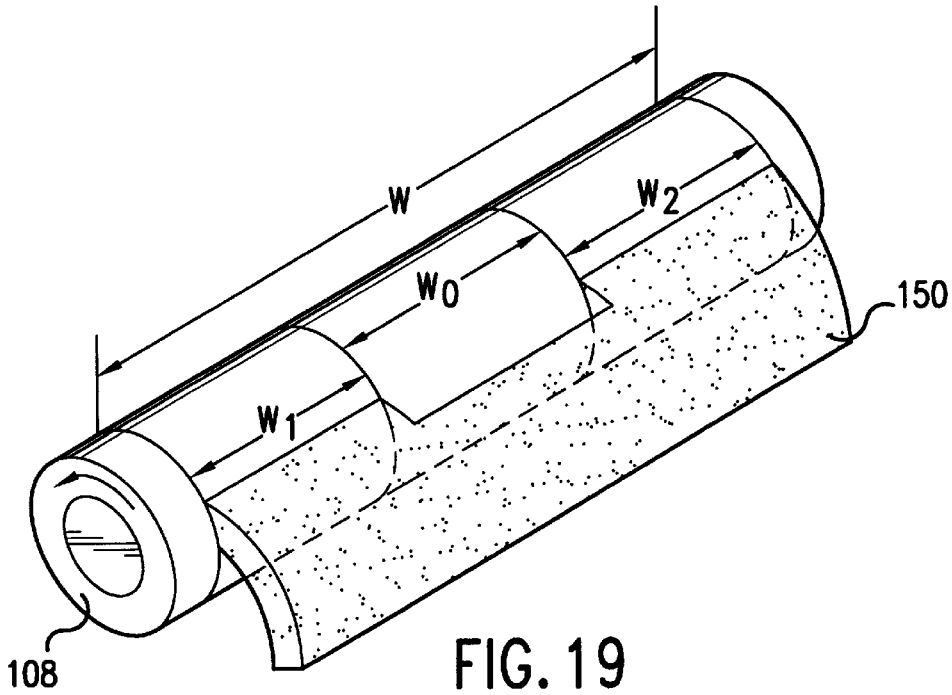
FIG. 19 is a perspective view of a modification of the release agent applying member as illustrated in FIG. 18 in accordance with the present invention.

Hereinbelow, a modification of the above-described embodiment is explained referring to FIG. 19. As shown in FIG. 19, a felt member as a material applying member 150 which includes a recess having a width W0 formed at a leading edge and approximately a center thereof, is employed. The felt member 150 contacts the heating roller 106 rotating in a predetermined direction, to apply release agent only from side area W1 and W2 thereof. The trailing edge of the felt 150 is submerged in silicon oil contained in a release agent tank (not shown). Thus, the oil is applied only to the side surfaces of the heating roller 106 having widths of W1 and W2 shown in FIG. 19. A roller or rollers (not shown) for applying the release agent only to the side area W1 and W2 can be substituted for the felt member 150.

Since only the surfaces of W1 and W2 of the pressure roller 108 receive silicon oil, the center of the surface thereof achieves a traction coefficient of approximately 0.4 greater than the surfaces of W1 and W2. Thus, wrinkling of the copysheet 124 can be avoided by the same reason as described above.

Figure 20:
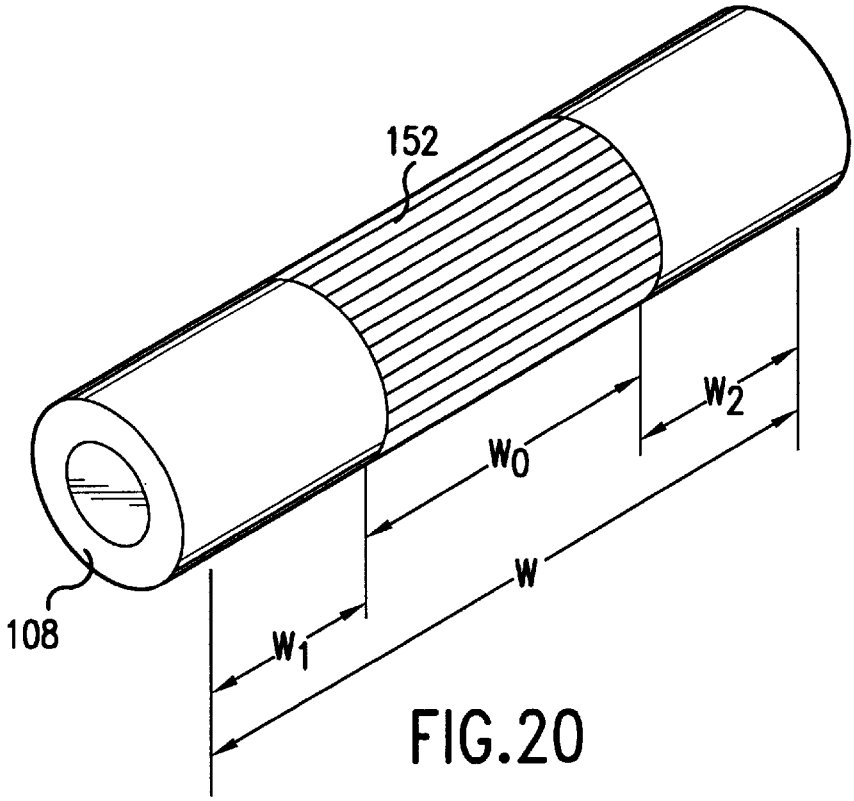
FIG. 20 is a perspective view of one of pressure rollers to be used in the fixing device as illustrated in FIG. 17 in accordance with the present invention.

Hereinbelow, another embodiment of the present invention is explained referring to FIG. 20. As shown in FIG. 20, a pressure roller 108 has a plurality of grooves, scratches or lines 152 formed in parallel to longitudinal axis thereof at an area having width W0 of the surface at a center thereof. Thus, the center of the surface of the pressure roller 108 has higher resistance (traction coefficient) than other portions of the surfaces having widths W1 and W2, since no grooves, scratches or lines are formed thereon. The width W0 has a length of about 80 mm, each of the plurality of grooves, scratches or lines 152 had a depth of about 0.3 mm and were disposed at an interval of about 3 mm around the entire surface of the pressure roller 108.

When considering a nip formed between the rollers 106 and 108 when the copysheet 124 is fixed, the interval of the scratches or the lines are preferably smaller than 3 mm, since no wrinkling of the copysheet 124 has been experienced in such a condition. A direction of the scratches is preferably to be made in parallel to the longitudinal axis of the pressure roller 108, but is not limited thereto. The same result can be obtained if the scratches are made inclined or made perpendicular to the axis, since the depth of the grooves, scratches or lines make the traction coefficient higher. Such a portion of the surface of the pressure roller 108 can be processed by finely grooved surfaces manufacturing process.

Figure 21:
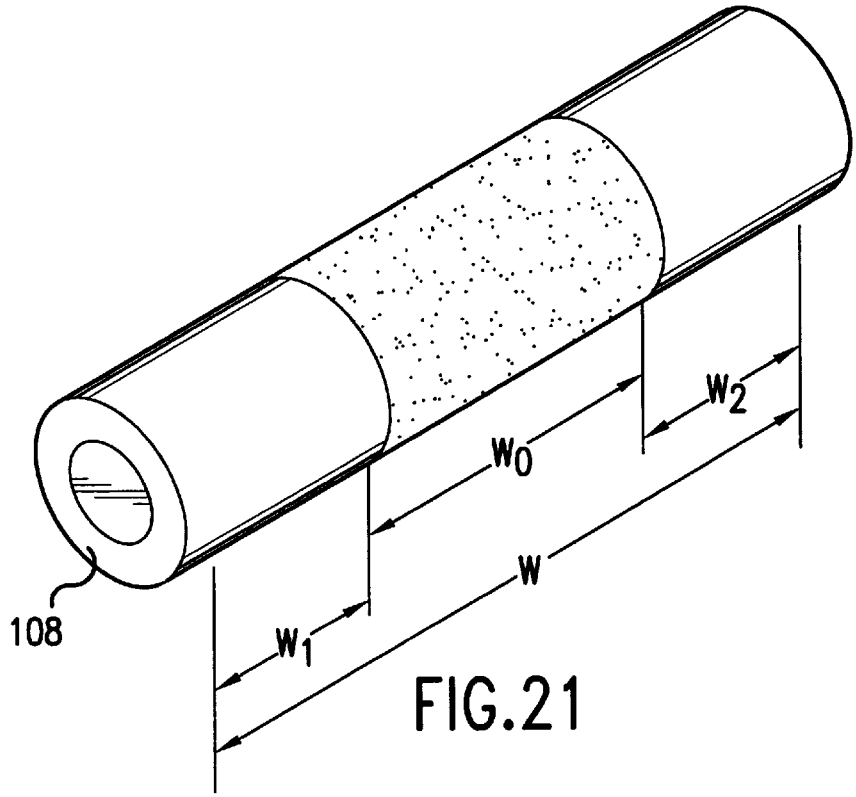
FIGS. 21, 22 and 23 are perspective views of modifications of the pressure roller as illustrated in FIG. 20.

Hereinbelow, another modification of the embodiment of the present invention is explained referring to FIG. 21. As shown in FIG. 21, a pressure roller 108 is employed and has surfaces differently roughened along the width thereof. A surface area having width W0 is formed at approximately the center thereof, which is roughened by a mechanical roughening method using a sandpaper or the like or a chemical roughening method. The surface area W0 is roughened so that a traction coefficient thereof is higher than other portions by approximately 0.8. Accordingly, a feeding speed of a center of the copysheet 142 is slower than the side portions, corresponding to the width W1 and W2 of the pressure roller 108 when the copysheet 142 is fed by a fixing device using the pressure roller 108. Thus, wrinkling thereof can be avoided by the same reason as described above. A corona-discharge method, a molding method, a shot peen process, a shot blast process or an etching process can be used for the mechanical and chemical roughening methods.

Figure 22:
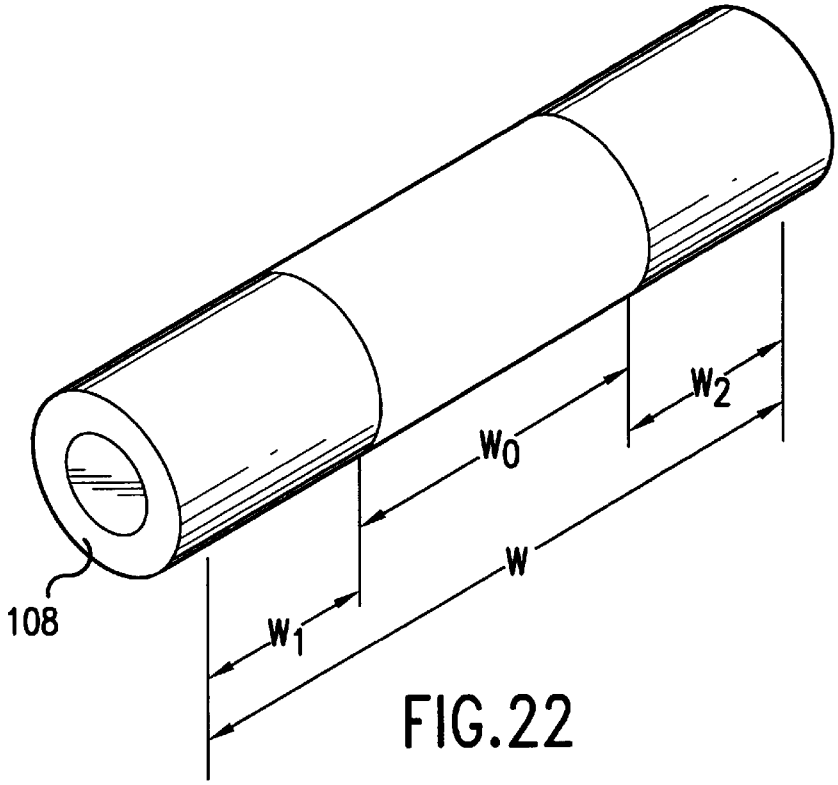

Hereinbelow, still another modification of the embodiment of the present invention is explained referring to FIG. 22. A pressure roller 108 includes a center surface area having width W0 and side surface areas each having widths W1 and W2. The surface area W0 and the side surface areas W1 and W2 are respectively made of different materials. The material for the surface area W0 has a higher coefficient than that of the side surface areas W1 and W2. For example, the center surface W0 may be made of silicon material having traction coefficient 1.5 and the side surfaces may be made of fluorine plastic material having coefficient 0.5. These materials are evenly coated around the core metal of the pressure roller 108. Thereby, the copysheet 142 is fed by the pressure roller 108 more slowly at a center thereof than by the portions.

Thus, the wrinkling thereof can be avoided by the same reason as described above.

Figure 23:
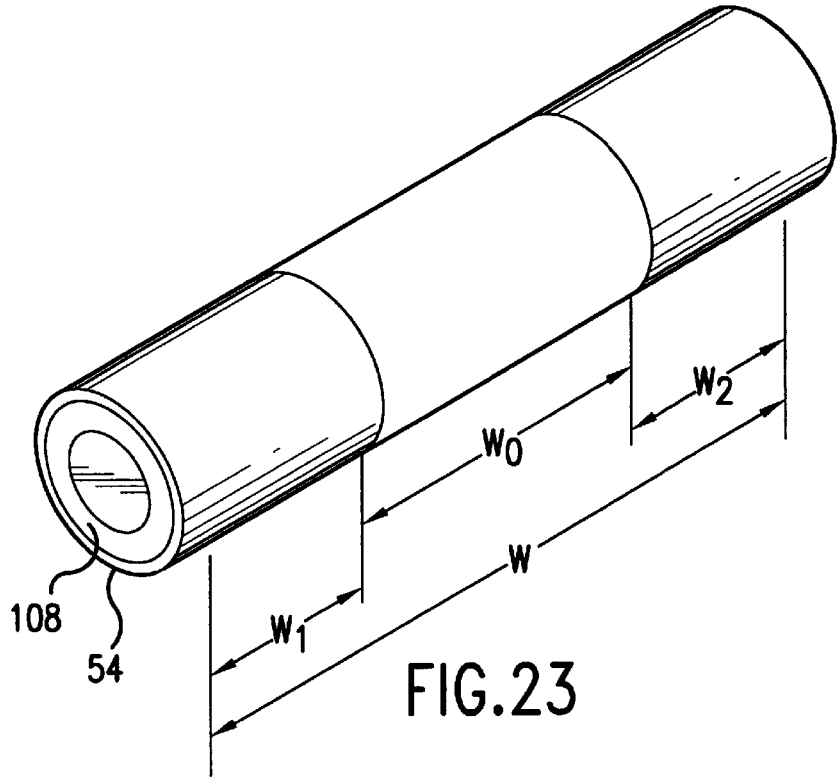
Figure 24:
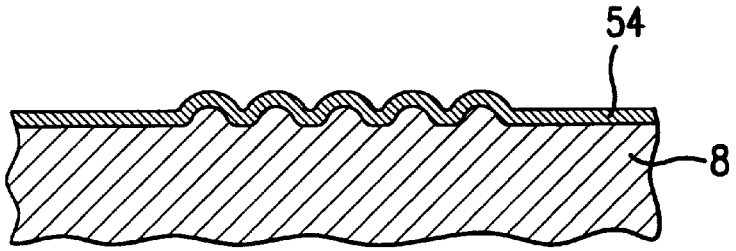
FIG. 24 is partial sectional view of the surface of the pressure roller illustrating one of roughness-conditions thereof in accordance with the present invention.

Hereinbelow, still another modification of the embodiment of the present invention is explained referring to FIGS. 23 and 24. A pressure roller 108 has a center surface area having width W0 and side surface areas each having widths W1 and W2. The surface area W0 is mechanically or chemically roughened to form trivial roughened portions thereon and after that fluorine plastic 154 is coated therearound. As a result, traction coefficient of the central surface of the pressure roller 108 becomes higher than other surfaces thereof by approximately 0.4. Accordingly, the wrinkling of the copysheet 154 can be avoided by the same reason as described above. Further, the above-described variety of embodiments can be selectively combined.

Figure 25:
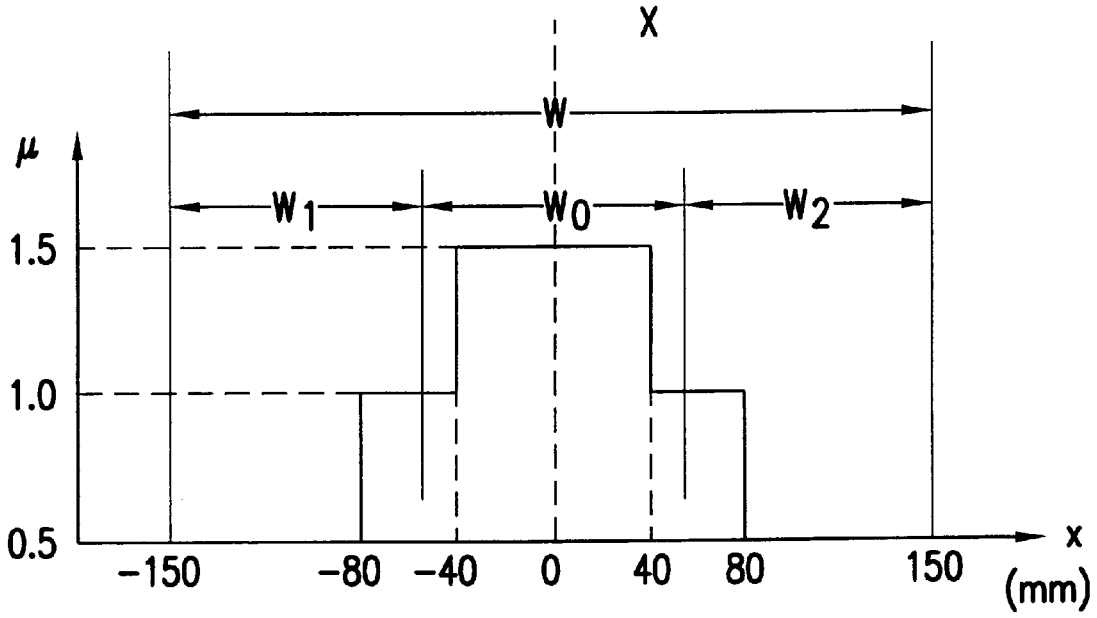
FIGS. 25, 26 and 27 are graphs each illustrating traction coefficient distributions of the surface of the modifications of the pressure roller as illustrated in FIG. 20, in which the traction coefficient varies along the width thereof.

Hereinbelow, still another modification of the embodiment of the present invention is explained referring to FIG. 25. In FIG. 25, the vertical axis indicates traction coefficient and the horizontal axis indicates a width of a pressure roller 108. A plurality of surfaces is differently roughened by either mechanical or chemical processes described above so that the center surface thereof has higher traction coefficient. However, the center surface thereof is roughened in two levels. For example, as illustrated in FIG. 25, each of the right and left side portions of the center (o) of the horizontal axis on the graph has a traction coefficient curve having widths of 40 mm at a first level of $1.5\mu$. Further, each of intermediate side portions of both the right and left side portions of the center (o) has also a width of 40 mm at a second level of $1.0\mu$.

Accordingly, a center having a width of 80 mm of the copysheet 142 is fed slower than the intermediate portions thereof, which are fed slower than the outermost side portions thereof. As a result, the wrinkling of the copysheet 142 can be effectively suppressed since the traction coefficient varies in two levels. Three or more levels of traction coefficient are preferable to be used, since wrinkling resulting from a sharp change in traction coefficient of the surface can be avoided. Further, in all of the above described embodiments, variations of traction coefficient along the width of the pressure roller 108 or the heating roller 106 is preferable if symmetrically made, since a skew of the copysheet can be avoided.

Figure 26:
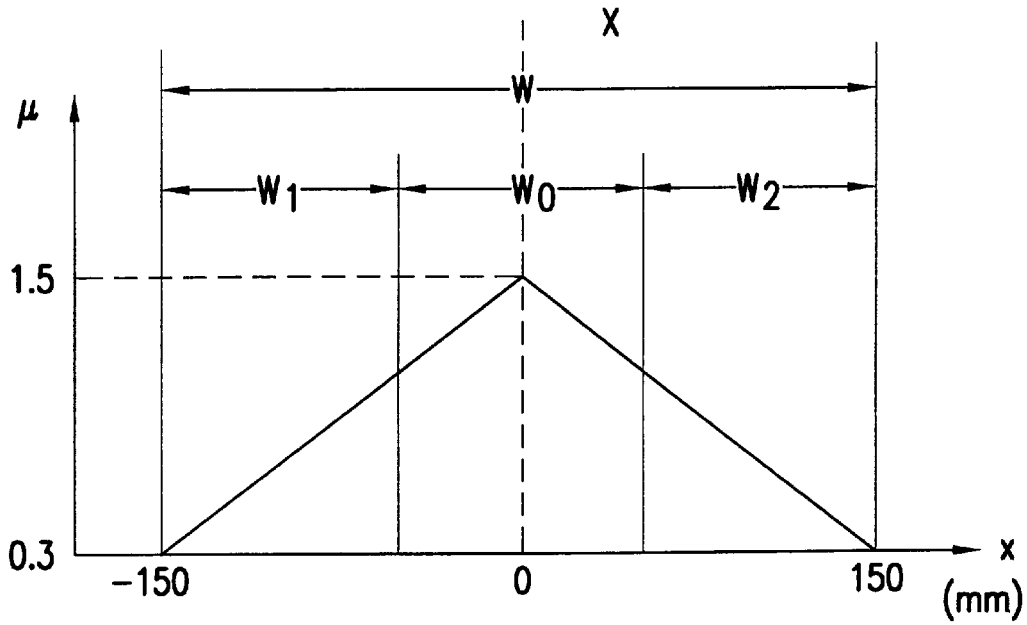

Further, the traction coefficient $\mu$ can linearly vary in a state that it is largest at the center of the width of the pressure roller 108 and gradually decreases from the center to the edges as illustrated in FIG. 26. The variations of the traction coefficient $\mu$ is given by below listed formulas, for example.

$$\mu=1.5+8\times X^{-3}\ (-150\leqq X\leqq 0)$$

$$\mu=1.5-8\times X^{-3}\ (-150\leqq X\leqq 0)$$

Accordingly, since the traction coefficient $\mu$ gradually changes along the width of the pressure roller 108, the wrinkling of the copysheet 142 can efficiently avoided. As described above, it is preferable that the traction coefficient $\mu$ varies symmetrically along the width of the rollers.

Figure 27:
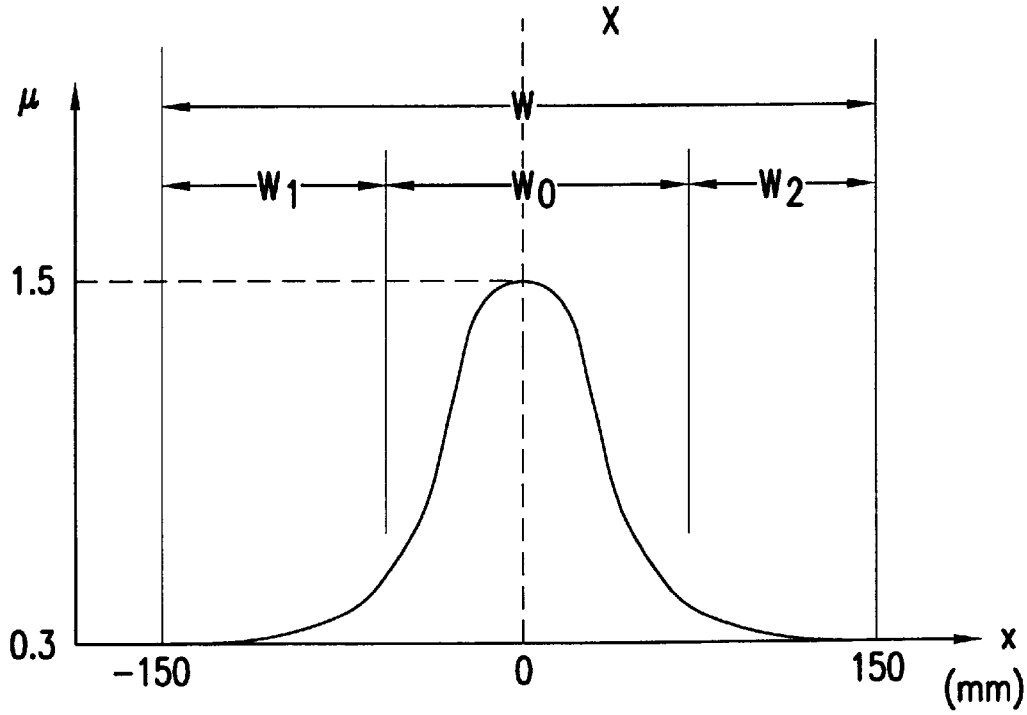

Further, the traction coefficient $\mu$ can vary to form a gauss function curve where the traction coefficient $\mu$ is largest at the center (o) of the width of the pressure roller 108 and gradually decreases along with both the right and left side edges thereof as illustrated in FIG. 27. The variation of the traction coefficient $\mu$ is given by below listed formulas, for example.

$$\mu=0.8+1.2\times\exp(-7.0\times10^{-4}\times X^{2})$$

$$(-150\leqq X\leqq 150)$$

Accordingly, since the traction coefficient $\mu$ gradually changes along the width of the pressure roller 108, the wrinkling of the copysheet 142 can efficiently avoided. As described above, it is preferable that the traction coefficient $\mu$ varies symmetrically. The above-described traction coefficient $\mu$ is obtained by the methods or process described earlier. As also described earlier, the fixing apparatus 102 may be utilized in copiers, facsimile machines and printers, and the copysheet 142 can carry a mono color toner image or a full color toner image on it's backside surface or can be an OHP sheet.

Figure 28:
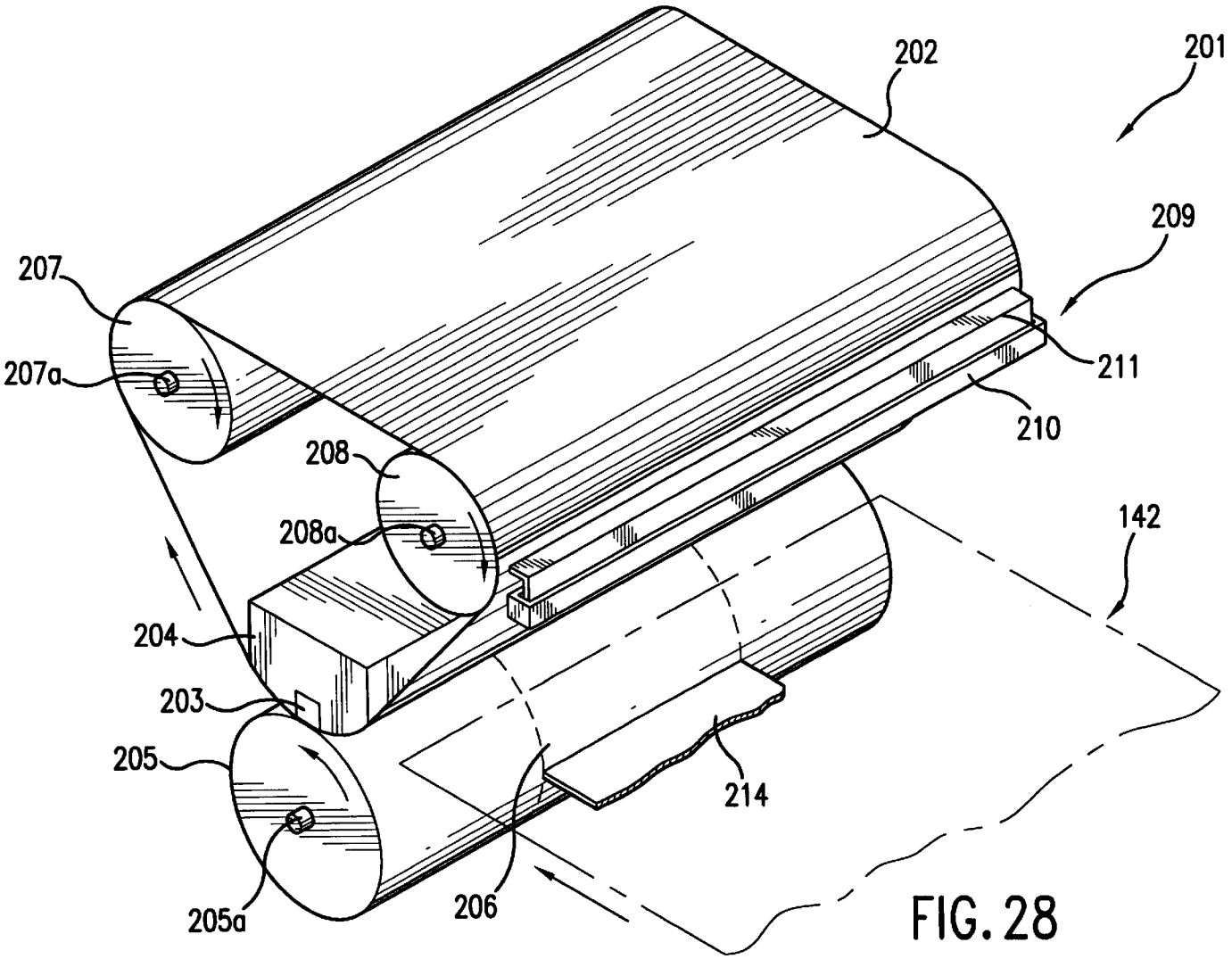
FIG. 28 is a perspective view of a fixing device of a third embodiment of the present invention, which uses a belt type-fixing device.

Hereinbelow, a third embodiment of the present invention is explained referring to FIG. 28. As shown in FIG. 28, a fixing device 201 includes a fixing endless belt 202 which feeds the copysheet 142 by rotating itself around a heating member 204 having a heat element 203 therein and thereby applies heat to the copysheet. The fixing device 201 further includes a pressure roller 205 which is biased by a spring, not shown, and disposed against the heating member 204 in pressure contact with the fixing endless belt 202 by a predetermined pressure.

A center surface area 206 of the pressure roller 205 is roughened more than the side surface portions thereof so that traction coefficient of a center of the copysheet 142 to be fed by the fixing apparatus 201 is fed slower than side portions thereof. To wind and rotate the endless fixing belt 202, both rollers 207 and 208 one of which is driven by a motor (not shown) are employed beside heating member 204. Endless fixing belt 202 can be made of polyamide plastic, alamide plastic or the like having a heat resistance. The heating member 204 is disposed against the pressure roller 205. Accordingly, a surface of the heat element 203, which contacts endless fixing belt 202 at a fixing station, has a mirror-like surface so that the endless fixing belt 202 smoothly slides therethrough. Further, both leading and trailing edge portions thereof are tapered to obtain smooth passage of the endless fixing belt 202. The heating member 204 is made of aluminum, for example, having a heat resistance and electrical insulating characteristics.

However, it is not limited to such material, namely, another material having the same characters and complex material involving such the material can be used. The heat element 203 may be made of Ta2N and disposed at a lower surface of the heating member 204 and extends along the width thereof along a line. However, it is not limited such a material, namely, another conventional heat generating material can be used and the shape of which can be a belt state.

The pressure roller 205 is driven around the axis 205*a* by the endless fixing belt 202 and has almost same width as the endless fixing belt 202. Both widths of the pressure roller 205 and endless fixing belt 202 are larger than the width of 300 mm of widest copysheet 142 to be fixed. A pipe (not shown) made of aluminum constitutes the pressure roller 205 and an elastic layer made of silicon rubber, for example, having a heat resistance coated around the pipe. As pipe material, a metal such as steel, stainless steel, nickel or the like, alloy, ceramic and so on can be used. A motor, as described earlier, drives the roller 207, the endless fixing belt 202 and the pressure roller 208. An oil applying member 209 is disposed at an opposite side of the endless fixing belt 202 against the roller 208 to apply a silicon oil as a release agent.

A blade 214 having width of 100 mm is disposed in a state that one edge thereof contacts a center surface of the pressure roller 205 to collect the silicon oil from the surface. A blade-support member (not shown) mounts another edge of the blade 214, and is slidably mounted along the width of the pressure roller 205 on the fixing device 201. Such a blade-support member is controlled to change a contact portion thereof with the surface of the pressure roller 205, so that the blade 214 always locates a center of an area through which the copysheet 142 passes, regardless of variation of the copysheet 142 to be fixed. Thereby, an area having high traction coefficient is obtained near the center on the surface of the pressure roller 205. A felt member or oil-collecting roller can be substituted for the blade 214.

As illustrated in FIG. 28, the oil applying device 209 is constituted by an oil container 210 disposed adjacent the endless fixing belt 202 for containing the silicon oil, for example. An oil applying member 211 may be made of a felt, one end of which sinks into the oil while another contacts the surface of the endless fixing belt 202.

Figure 29:
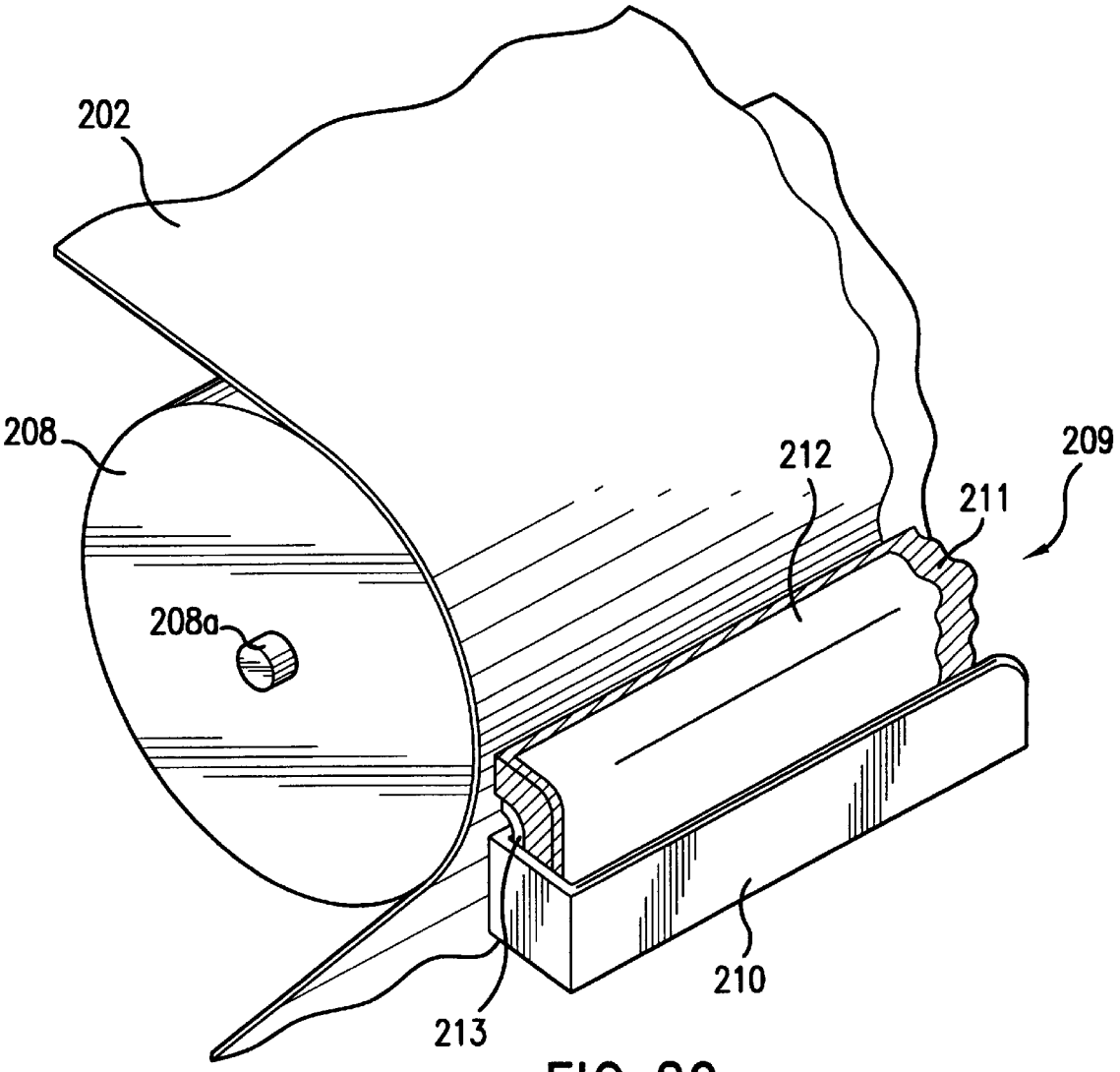
FIG. 29 is a partial expanded perspective view of a fixing device including a release agent applying device of the embodiment as illustrated in FIG. 28.
Figure 30:
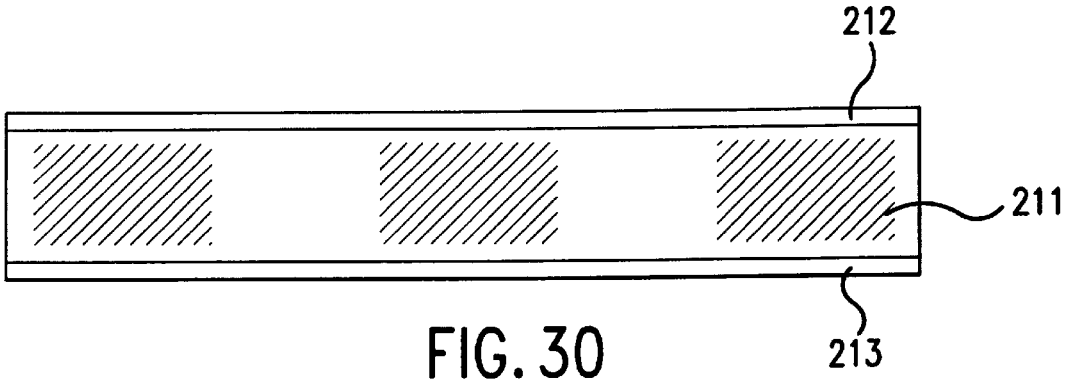
FIG. 30 is a plan view of the cross section of the release agent applying member used in the release agent applying device as illustrated in FIG. 29.

As shown in FIG. 29, the oil applying device 209 is further constituted by both an upper guide plate 212 and lower guide plate 213 which cooperatively support the oil applying member 211 at a predetermined position.

Both the upper plate 212 and lower plate 213 are disposed in parallel to each other so that the oil can be evenly applied along the width thereof due to an evenly applied compression force to the oil applying member 211. Thus, when an image forming apparatus as illustrated in FIG. 1 starts operation, an electrical power is applied to the fixing apparatus 201 to preheat thereof. Further, the plurality of rollers 205, 207, 208 and the endless fixing belt 202 are rotated to prepare a fixing process, and the oil applying device 209 then evenly applies the oil to contacting surfaces of the endless fixing belt 202. After that, the oil applied thereon is transferred onto the surface of the pressure roller 205. The blade 214 then collects the oil on the center of the surface of the pressure roller 205 therefrom. Thereby, traction coefficient of the center 206 of the surface of the pressure roller 205 is higher than the side portions of surfaces thereof by 0.5 point.

When an image forming process is started after the fixing device is preheated, the copysheet 142 having a toner image thereon is fed to the fixing station where the fixing belt 202 and the pressure roller 205 are disposed. During passing of the copysheet 142 through the fixing station, the toner is firmly fixed thereon by a heat applied from the fixing belt 202 heated by the heat element 203. Since the release agent is entirely and evenly applied onto the surface of the fixing belt 202, the toner is not offset thereonto.

Further, since an area 206, which corresponds to a center of the copysheet 142 to be fed, has high traction coefficient and is formed on an almost center of the surface of the pressure roller 205, some tension directing the copysheet 142 from the center towards the sides occurs. Thus, the copysheet 142 is expanded by the tension thereby resulting in no wrinkling. Thus, the copysheet 142 is safely fed and ejected from the image forming apparatus.

Figure 31:
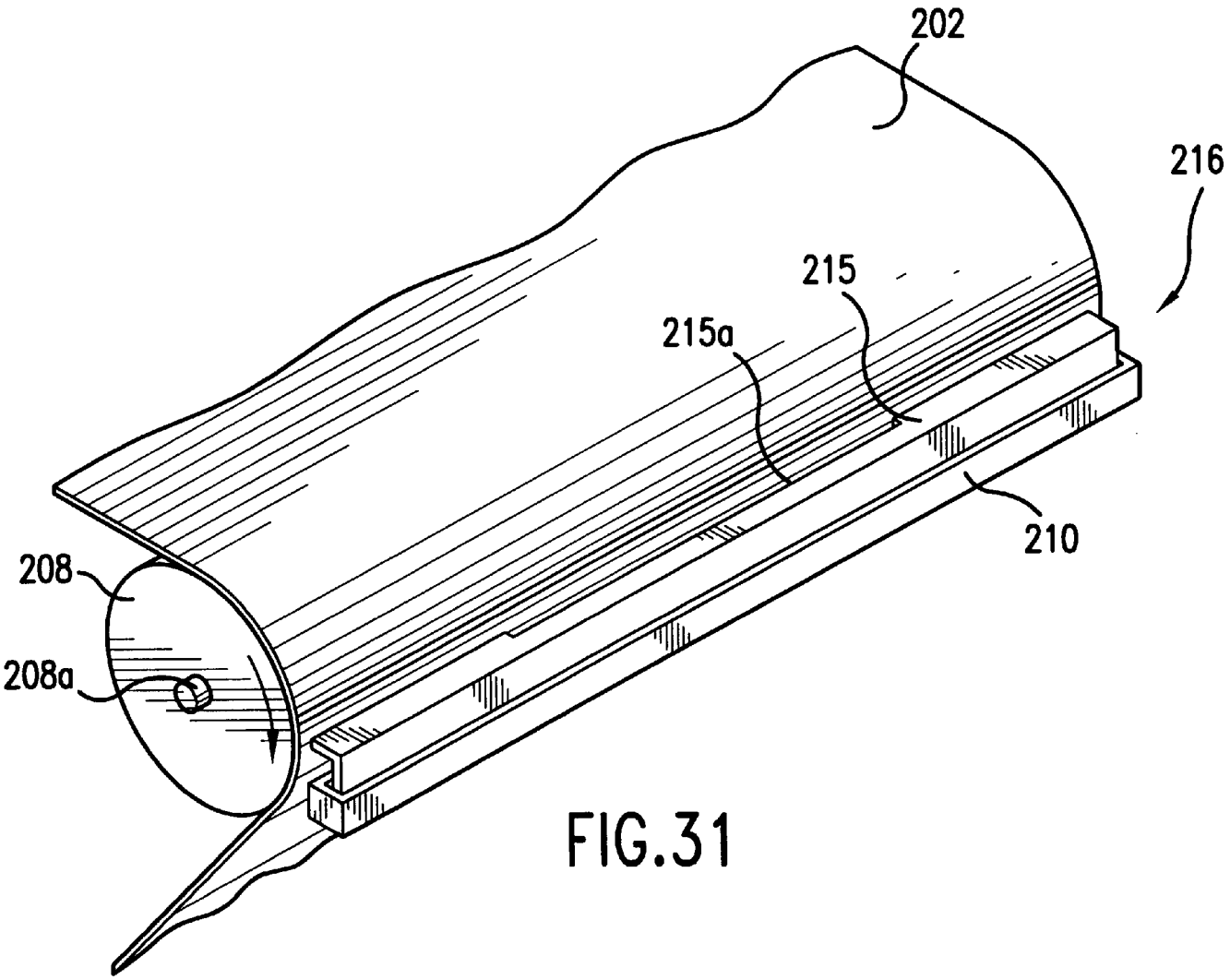
FIG. 31 is a partial perspective view of a modification of the release agent-applying device as illustrated in FIG. 30.

Hereinbelow, a modification of the above-described third embodiment of the present invention is explained referring to FIG. 31. As illustrated in FIG. 31, an oil-applying device 216 includes an oil-applying member 215 having a recess 215*a* having width of 100 mm, for example, at a center thereof. The material-applying device 216 contacts a surface of the endless fixing belt 202 in the same manner as described earlier. A setting position of the oil-applying member 215 against the endless fixing belt 202, an oil container, and both upper and lower guides have a structure as described in the above.

Since, the material applying member 215 has recess 215*a*, the oil as a release agent is coated only on the surface of the fixing belt 202 to which an edge portion of the oil-applying member 215 contacts. Thus, the center 206 of the surface thereof does not carry the oil thereon, accordingly, traction coefficient thereof becomes higher than other side portions thereof by approximately 0.4 point as illustrated in FIG. 16. Thus, the cleaning blade 214 as employed in the earlier described embodiment is not required in the modification.

Figure 32:
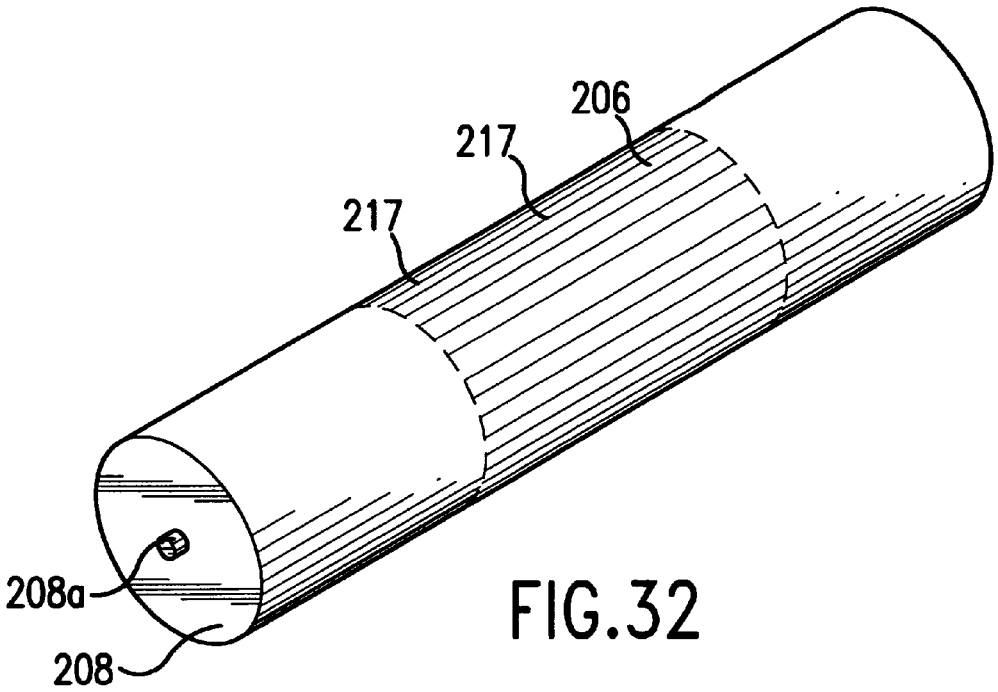
FIG. 32 is a perspective view of a pressure roller to be used in the fixing device as illustrated in FIGS. 29 and 31, which illustrates a surface condition thereof.
Figure 33:
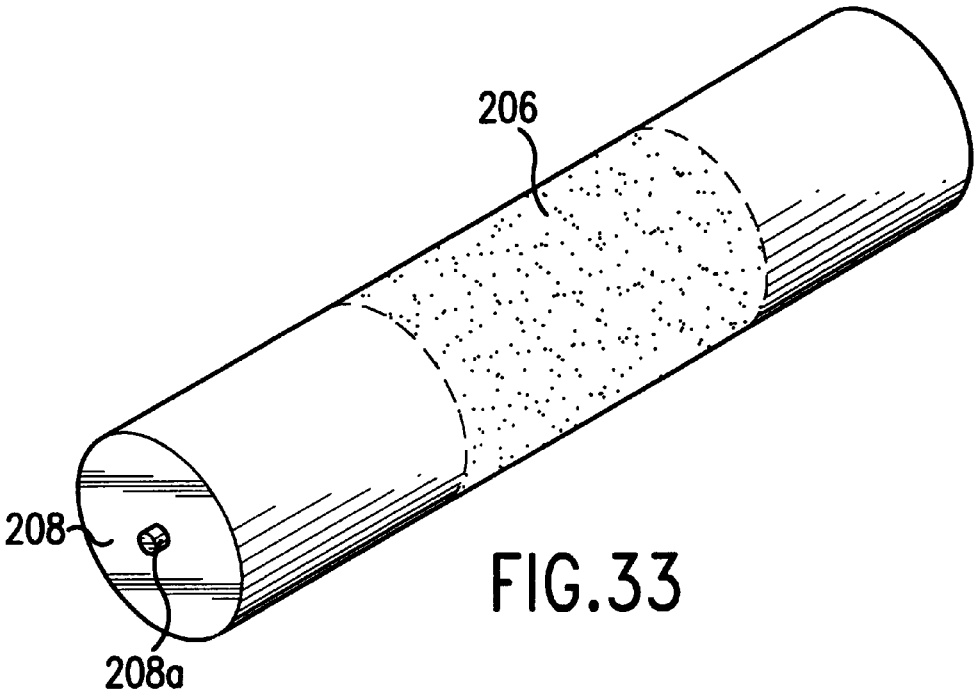
FIGS. 33 and 34 are perspective views of modifications of the pressure roller as illustrated in FIG. 32.
Figure 34:
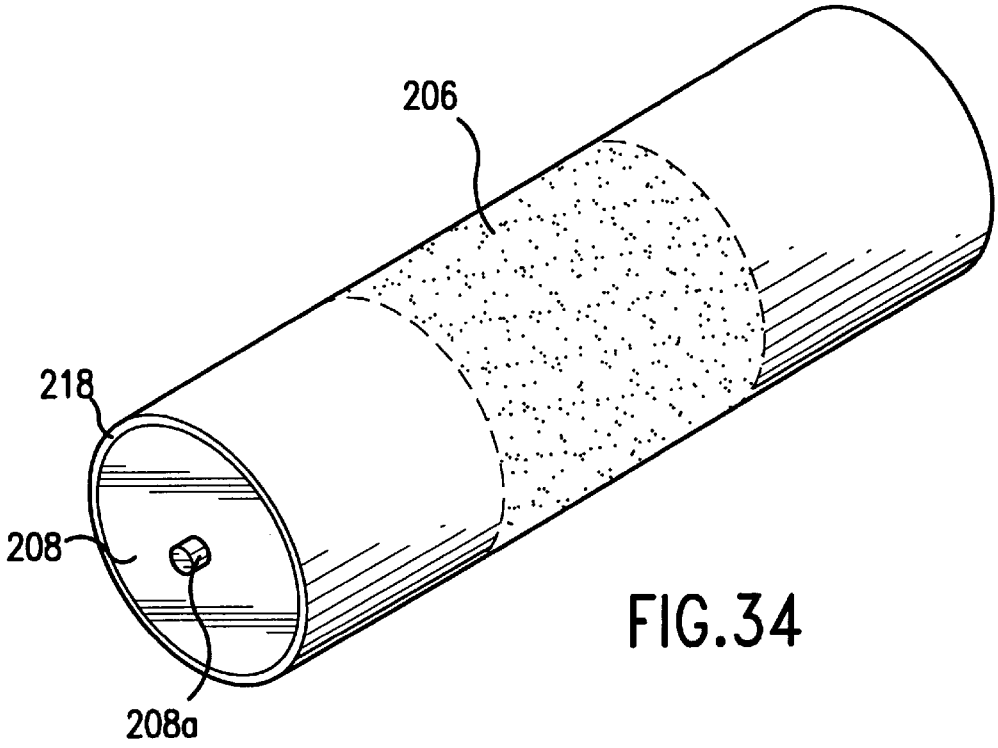
Figure 35:
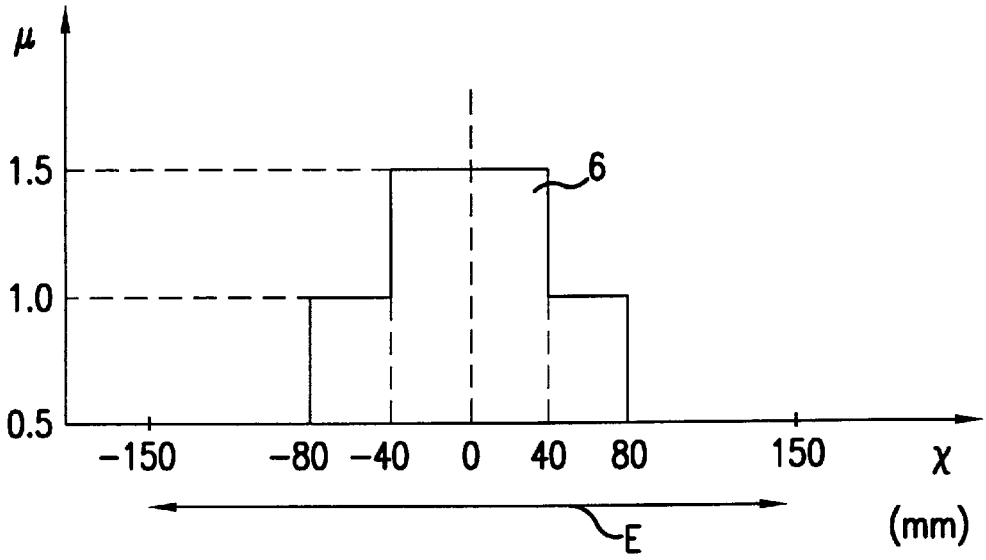
FIGS. 35, 36 and 37 are graphs illustrating distributions of traction coefficients of surfaces of the corresponding pressure rollers used in the fixing device as illustrated in FIGS. 29 and 31 along the width thereof.
Figure 36:
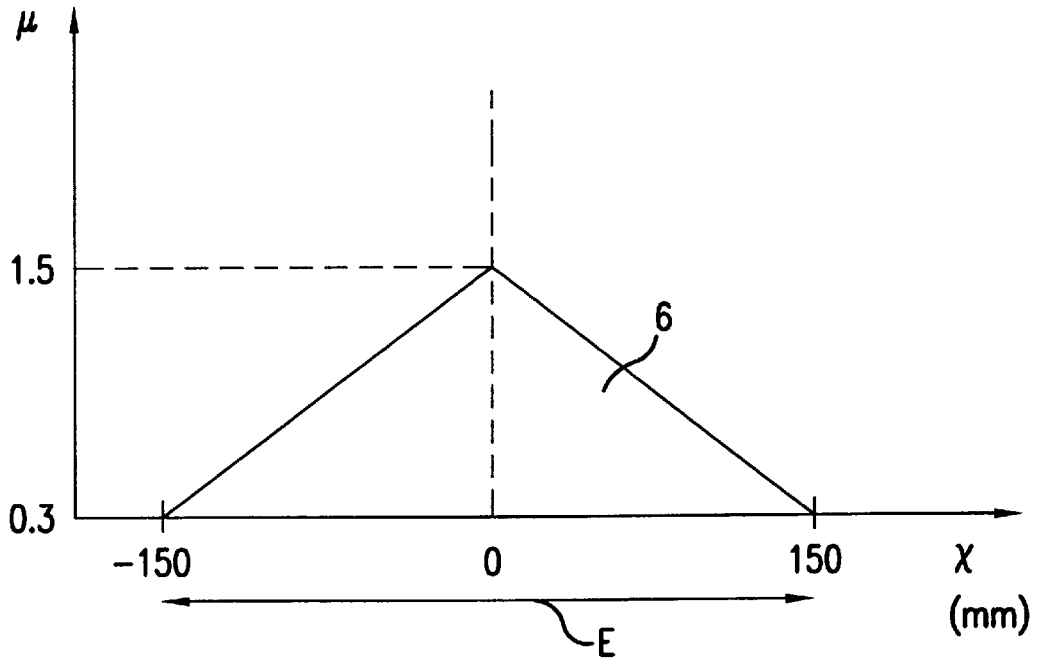
Figure 37:
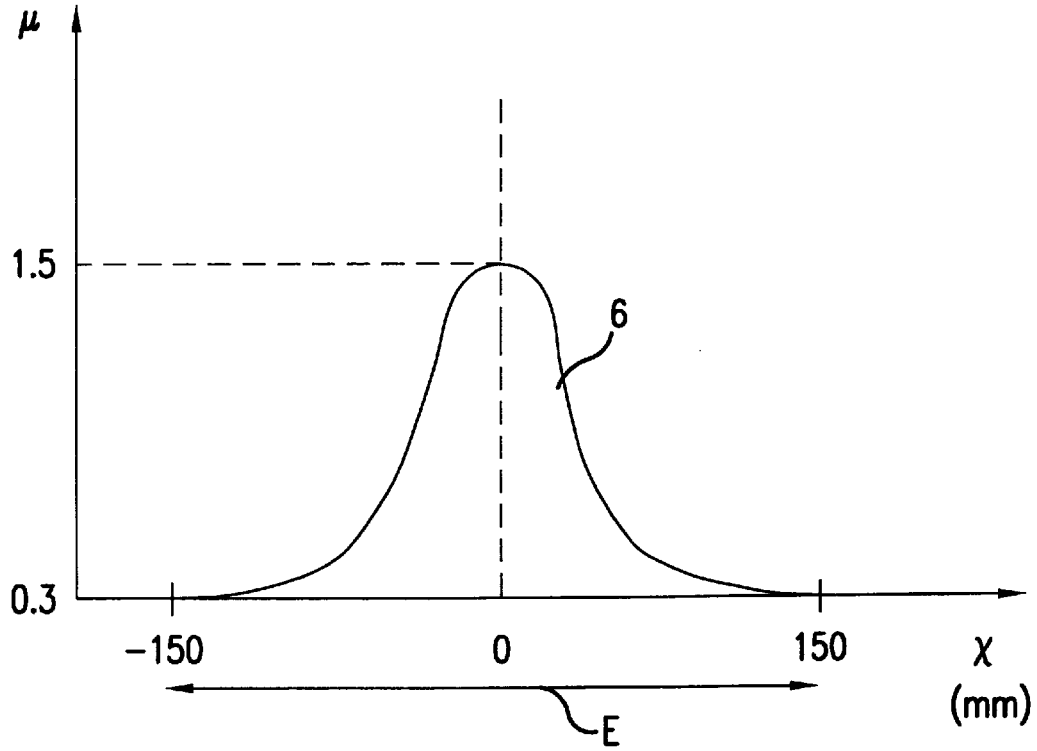

Furthermore, an area having high traction coefficient can be directly made on a surface of the pressure roller 205 which contacts the fixing belt 202, by using the above-described material applying device 216. Further, as illustrated in FIGS. 32, 33 and 34, a high traction coefficient area can be made on the surface of the pressure roller 208 by the same manner as the pressure roller 108 as illustrated in FIGS. 19 and 20. Further, as illustrated in FIGS. 35, 36 and 37, traction coefficient of the surfaces of the above described pressure roller 208 can be obtained as the same state as illustrated in FIGS. 25, 26 and 27. Further, to obtain the above-described distribution of the traction coefficient by only using the oil applying member 211, gaps between the upper guide 212 and lower guide 213 is varied along the width thereof as illustrated in FIGS. 38 and 39.

Figure 38:
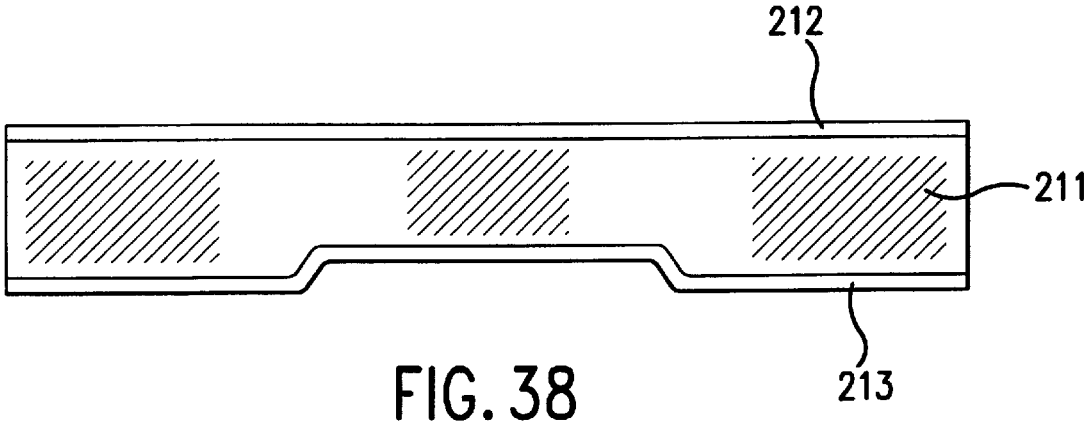
FIGS. 38 and 39 are cross sectional views of modifications of the release agent applying member as illustrated in FIG. 30.
Figure 39:
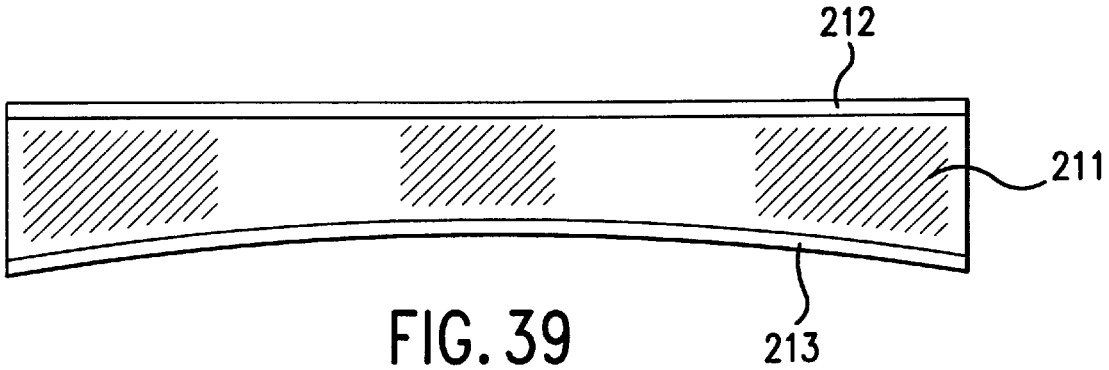

FIG. 38 illustrates the gaps thereof which varies in a step by step manner, and FIG. 39 illustrates the gaps thereof, which does not linearly vary. Thus, if the gap is narrowed at a center by guides 212 and 213, the oil applying member 211 is compressed at the portion, accordingly an osmotic rate of the oil per oil applying member 211, at the portion is relatively decreased. Thus, an area of the surface having high traction coefficient is formed either on the endless fixing belt 202 or the pressure roller 205, since the oil is less applied onto the center of the surface each thereof.

Figure 40:
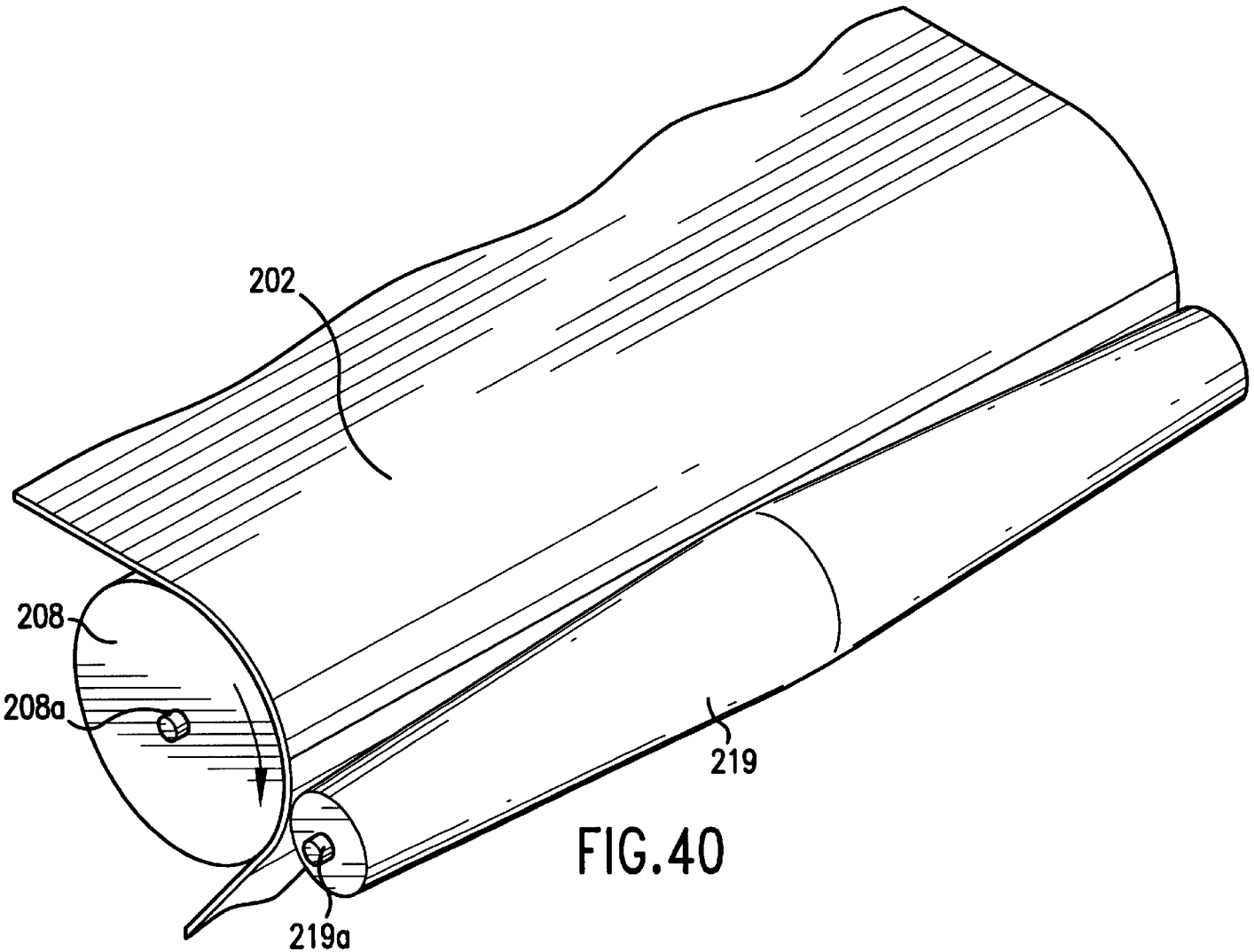
FIG. 40 is a partial perspective view of still another modification of the release agent applying device as illustrated in FIG. 29, which uses a roller type release agent applying member having different diameters.

Further, if a material-applying roller 219 driven by the endless fixing belt 202 having diameters varying from largest at the center thereof to smallest at its sides is utilized as illustrated in FIG. 40, the same result as described above can be obtained. This is because when the roller 219 in pressure contact therewith evenly along the with thereof, a portion having a larger diameter applies less oil to the surface of the endless fixing belt 202, for example, due to a strong pressure caused therebetween. In the above, the oil containing member can also be used, since the structure thereof is same as described in the above.

Figure 41:
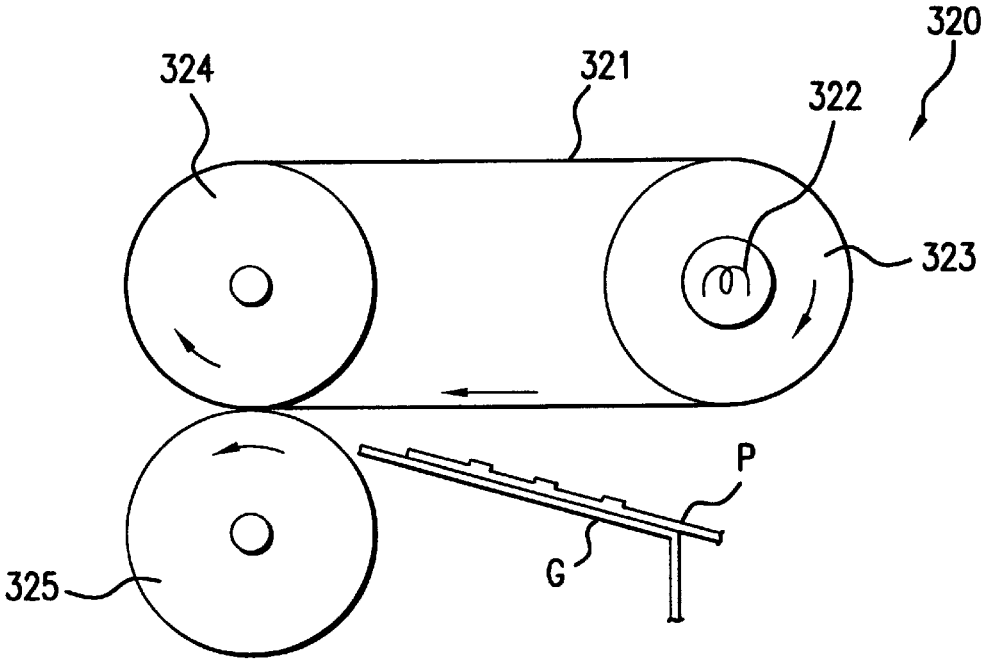
FIGS. 41, 42 and 43 are cross sectional views of fixing devices to which a plurality of embodiments and modifications of the present invention can be applied.
Figure 42:
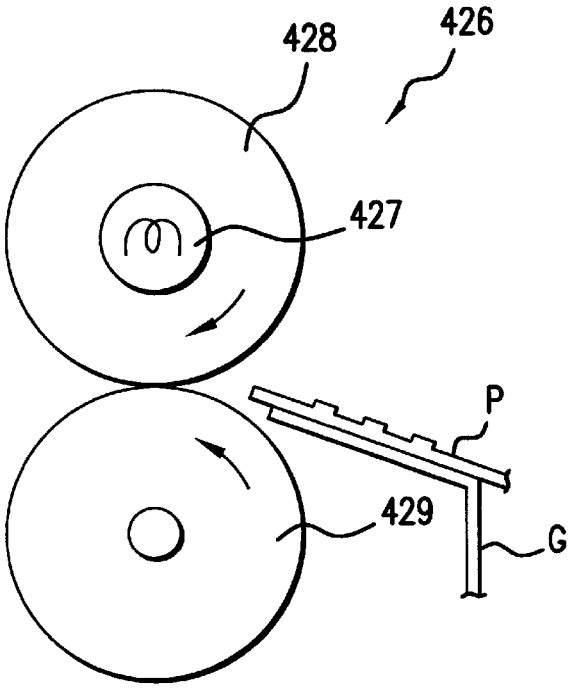

The above-described variety of high traction coefficient forming devices can be applied to a below-described fixing device as illustrated in FIGS. 41 and 42. As illustrated in FIG. 40, a fixing device 320 includes an endless fixing belt 321 which transfers a copysheet P carrying a toner image thereon. The fixing device 320 further includes a heating roller 323 having a heat element 322 therein which winds the endless fixing belt 321 therearound and applies heat thereto and a driving roller 324 which winds the endless fixing belt 321 therearound. The fixing device 320 further includes a pressure roller 325 in pressure contact with the endless fixing belt 321 against the driving roller 324 and a copysheet guide G which guides the copysheet P toward a fixing station between the endless fixing belt 321 and the pressure roller 325. The above-described fixing device 320 operates in a same manner as described above. In such a fixing device, the oil applying device can be disposed to contact the driving roller 324 or a desired portion of the endless fixing belt 321 to obtain the area having high coefficient on the endless fixing belt 321.

Further, another fixing device 426 as illustrated in FIG. 42 can be employed. The fixing device 426 includes a heating roller 428 as a driving roller having a heat element therein, a pressure roller 429 which in pressure contacts the heating roller 428 and a copysheet guide G which guides the copysheet P toward a fixing station between the heating roller 428 and the pressure roller 429. In such fixing devices, a non-rotation member which pressure contacts the surface of the fixing belt can be used for the pressure rollers 325 and 429. Further, a layer of silicon, for example, which is to be coated on each of the pressure rollers 325 and 429 can be omitted if not necessary.

Figure 43:
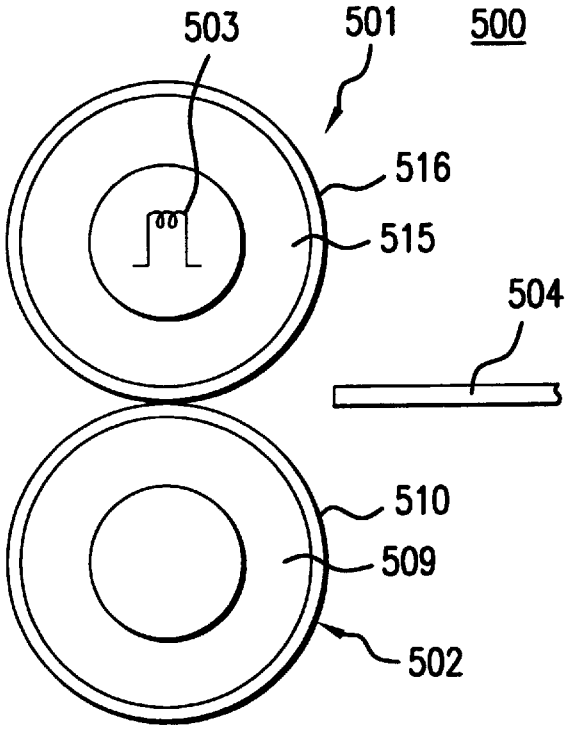

Hereinbelow, a fourth embodiment of the present invention is explained referring to FIG. 43. As shown in FIG. 43, a fixing device 500 includes a fixing roller 501 which freely rotates and has a heat element 503 therein, a pressure roller 502 which is disposed in pressure contact with the fixing roller 501 and a pair of bias springs (not shown) each connecting the axis of fixing roller 501 with that of the pressure roller 502 at end portions thereof. Thus, the pressure roller is in pressure contact with the fixing roller 501. Thus, a copysheet 504 is fixed when passing through the fixing device 500. The fixing roller 501 is constituted by a hollow cylinder 515 made of aluminum, for example, having unit-heat resistance.

The hollow cylinder 515 is coated with PFA 516 therearound and includes a halogen heater 503 therein, which applies heat to the fixing roller 501. The pressure roller 502 is constituted by a core metal 509 made of steel, for example, and a silicon rubber 510 wrapped therearound, for example. A maximum size for the copysheet 504 to be fixed during passing through the fixing device 501 is predetermined at a width of 300 mm. A motor (not shown) drives the fixing roller 501, and accordingly the fixing roller 501 drives the pressure roller 502.

Figure 44:
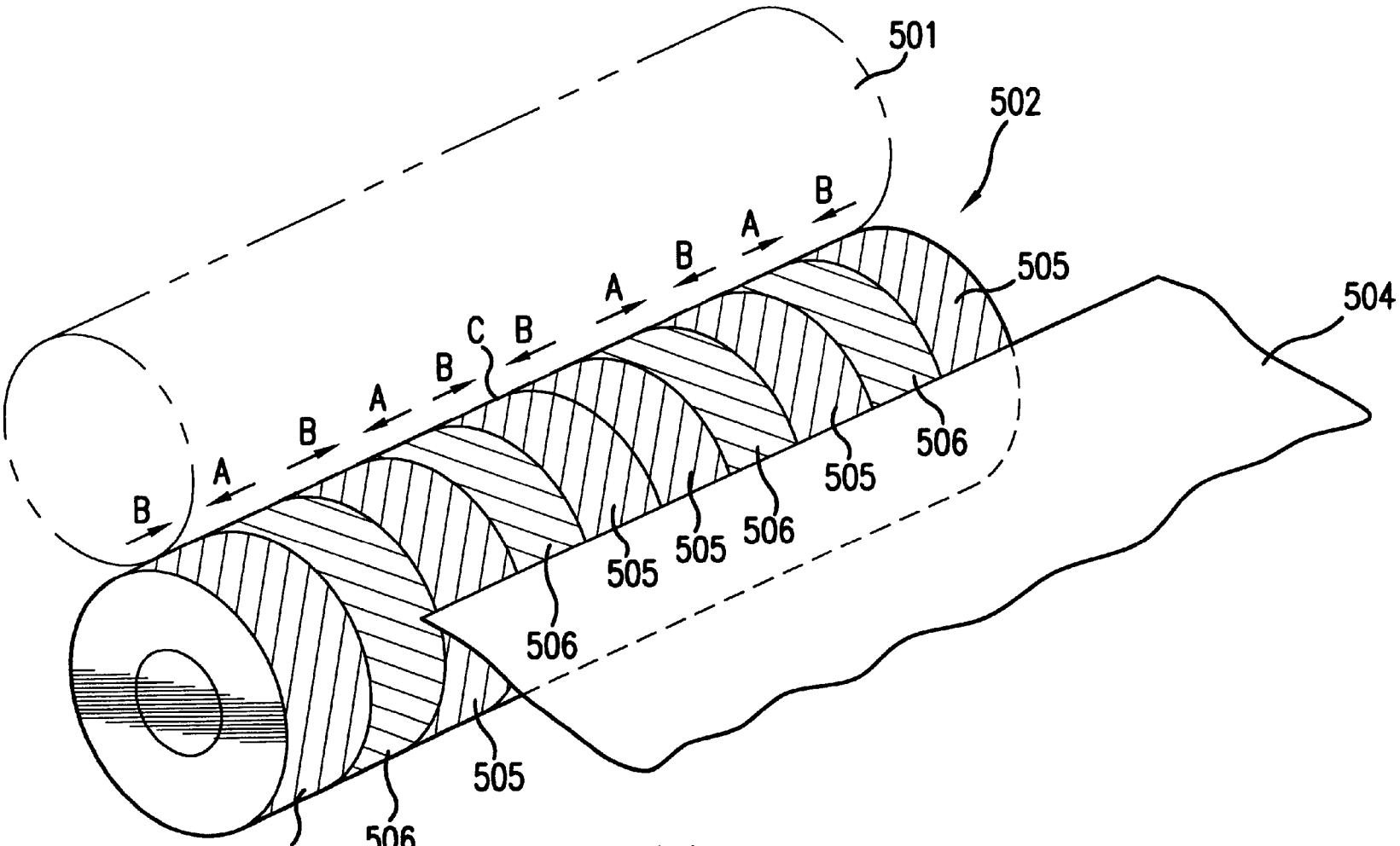
FIG. 44 is a perspective view of a forth embodiment of the present invention illustrating a fixing device having a plurality of pairs of different traction coefficient areas juxtaposed on the surface of the pressure roller.

Two kinds of areas 505 and 506 having different traction coefficient are alternatively formed on the surfaces of the pressure roller 502 as illustrated in FIG. 44. Such areas are symmetrically formed thereon about a central portion C which locates at a center of the width of the copysheet feeding area on the pressure roller 502 such that a higher traction coefficient area 505 is positioned at the center C. However, the lower traction coefficient area 506 can be positioned at the center C, since an almost same result can be obtained. Thus, a pair of opposite stresses (B) are generated at the center C of the pressure roller 505 and a plurality of pairs of stresses (A, B) are repeatedly generated along the width thereof beside the center so that each of stresses (A, B) are cancelled as illustrated in FIG. 44. Thus, each of the tensions to be made by the above described stresses when the copysheet 504 passes through the fixing device 500 are released, thereby none of stresses are not concentrated on the side edges of the copysheet 504. As a result, wrinkling of the copysheet 504 can be avoided.

Figure 45:
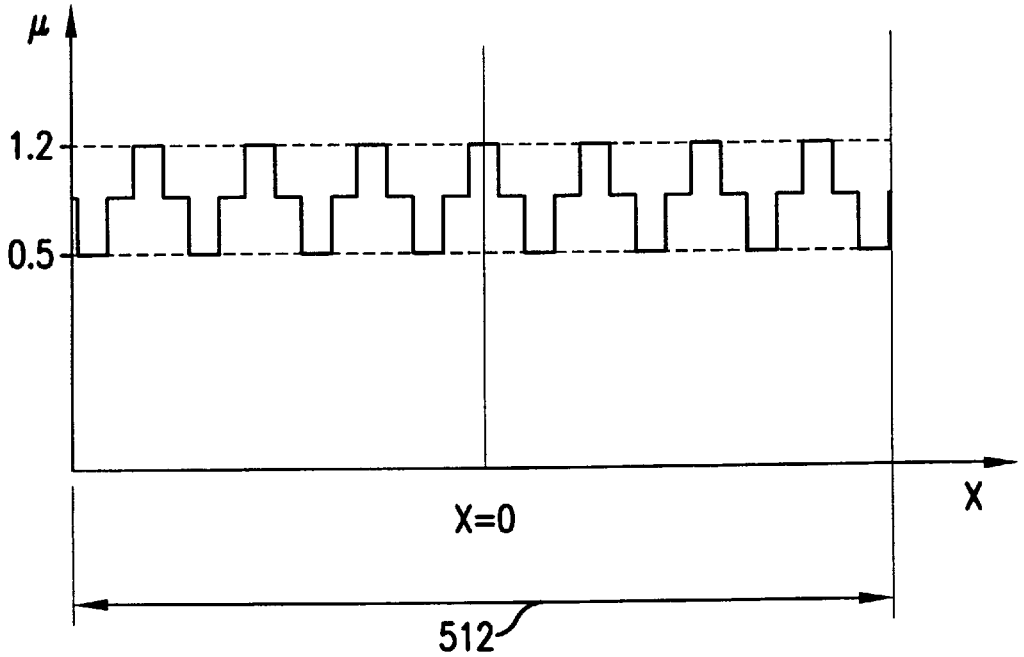
FIGS. 45, 46 and 47 are graphs illustrating traction coefficient distributions of surfaces of the pressure rollers each having the plurality of pairs of different traction coefficient areas as illustrated in FIG. 44 along the width thereof.

The above-described width of each of the areas of the surface can be varied so as not to be influenced by variations of the sizes of the copysheet 504 to be fixed. The width is preferably determined from about 20 mm to about 50 mm. The areas of different traction coefficient of the pressure roller 505 can be formed so that traction coefficient curve varies as illustrated in FIG. 45. As illustrated in FIG. 45, the traction coefficient curve varies between two levels of 0.5 and 1.2 in each of the areas so that it repeatedly and symmetrically changes about the central axis along the width of the copysheet-passing area of 300 mm.

Figure 46:
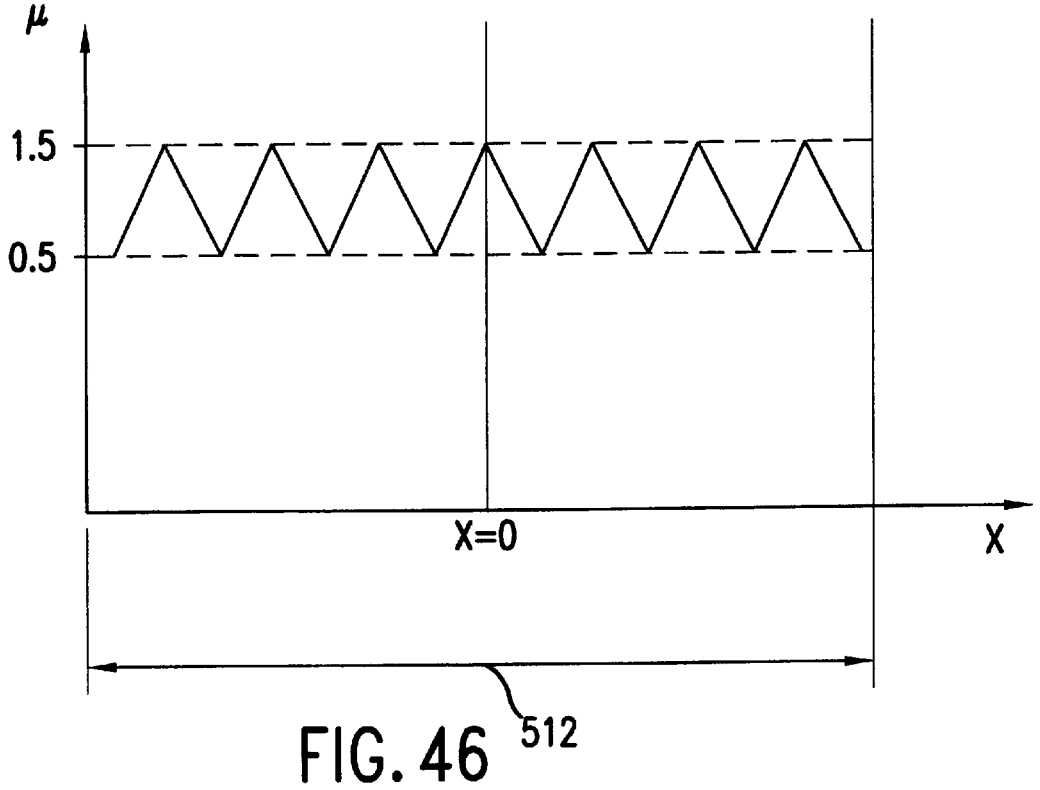
Figure 47:
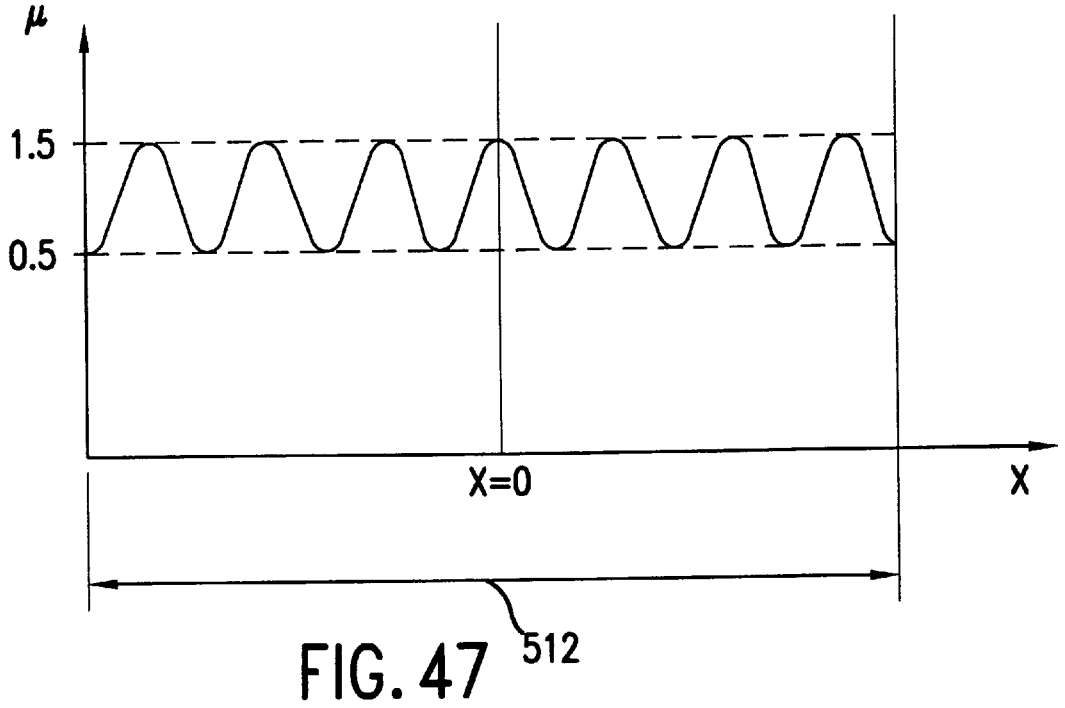

The above-described levels are not limited to two levels, namely, three or more levels are utilized if necessary. The stresses as described above are not concentrated at the both side edge portions of the copysheet 504 by the same reason as described above. Further, the same result is obtained when distribution of traction coefficient in each of the areas of the surface of the pressure roller 502 is formed as illustrated in FIGS. 46, 47 and 49. To form areas 508 each having different traction coefficient as illustrated in FIG. 48, sandpaper is utilized in a manner as described below.

Figure 48:
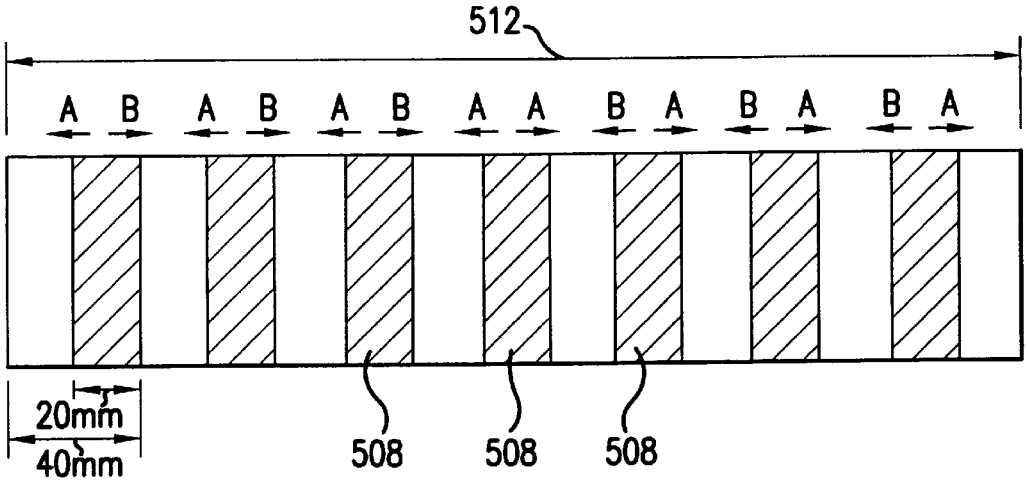
FIG. 48 is a plan view of another modification of the pressure roller as illustrated in FIG. 44, illustrating traction coefficient areas intermittently formed on the surface of the pressure roller.
Figure 49:
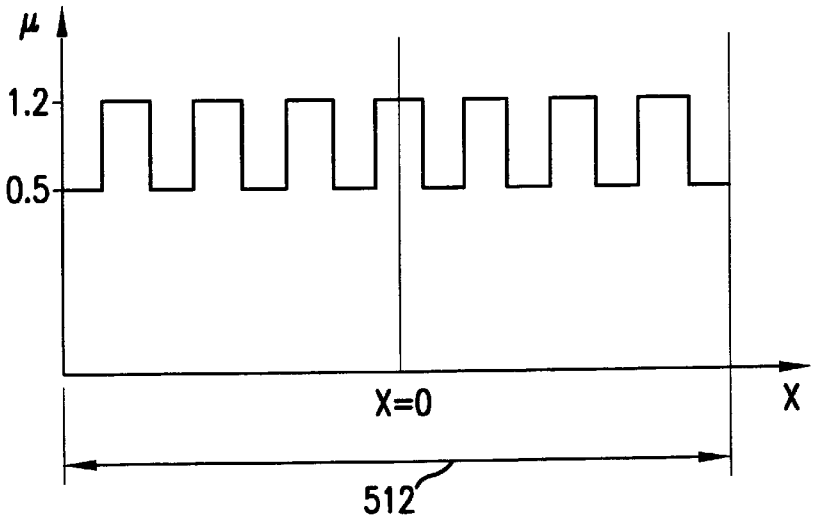
FIGS. 49 is a graph illustrating traction coefficient distribution on the surface of the pressure roller as illustrated in FIG. 48 along the width thereof.

As shown in FIG. 48, a plurality of areas each having width of 20 mm are formed at intervals of 20 mm on the surface of the pressure roller 502. A sandpaper is used to roughen each of the areas, for example, to obtain a higher traction coefficient than the interval portions by approximately 0.7. Thereby, stresses are not concentrated on both side edges of the copysheet 504 when it passes through the fixing device 500 by the same reason as described earlier. Of course, a corona discharging method and a molding method can be used to roughen the areas.

Figure 50:
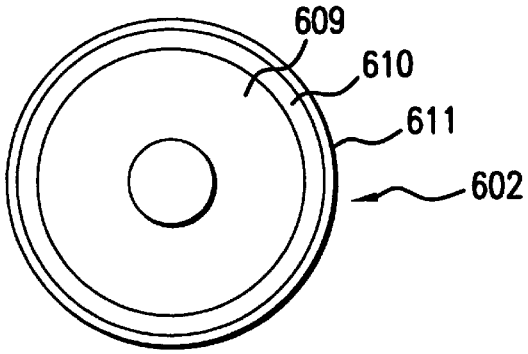
FIG. 50 is a cross sectional view of the modification of the pressure roller as illustrated in FIG. 48, and FIGS. 51 and 52 are plan views of still another modifications of the pressure roller as illustrated in FIG. 44, illustrating a plurality of pairs of different traction coefficient areas juxtaposed which are repeatedly formed along the width thereof.

Hereinbelow, modifications of the pressure roller to be used in one of the above-described embodiments is explained in detail referring to FIGS. 50, 51 and 52. As shown in FIG. 50, a pressure roller 602 includes two layers, one of which is an inner layer 610 constituted by a core metal 609 and a silicon rubber coated around, and another is an outer thin layer 611 made of fluorine plastic coated around the inner layer 610. A plurality of roughened areas 508 as illustrated in FIG. 48 are formed, for example, on the surface of the inner layer 610, and then the fluorine plastic, as an outer layer 611, is coated thereon. As a result, each of the roughened areas 508 has higher traction coefficient than other areas on the surface by approximately 0.4.

Figure 51:
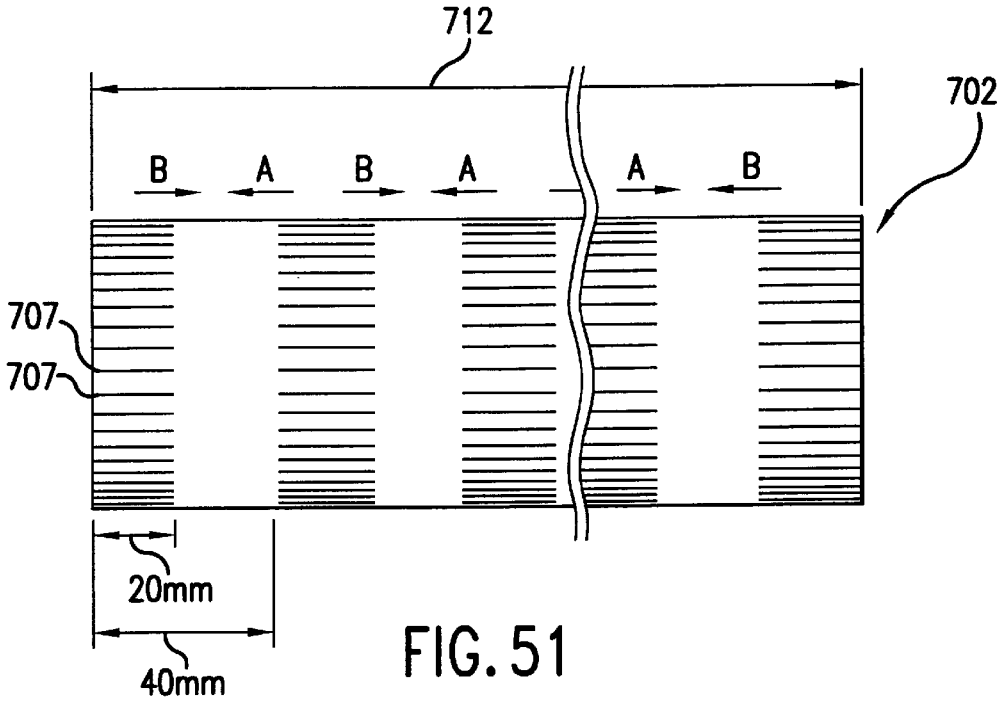

Further, instead of roughening the above-described areas, a plurality of scratches or grooves 707 can be made around the surface of the pressure roller 702 as illustrated in FIG. 51. Since each of the stresses generated on the surface of the copysheet 504 is cancelled during passing through the pressure roller 702, wrinkling thereof can be avoided by the same reason as described above. To vary the traction coefficient, the scratches or grooves can be increased in number or in depth.

Figure 52:
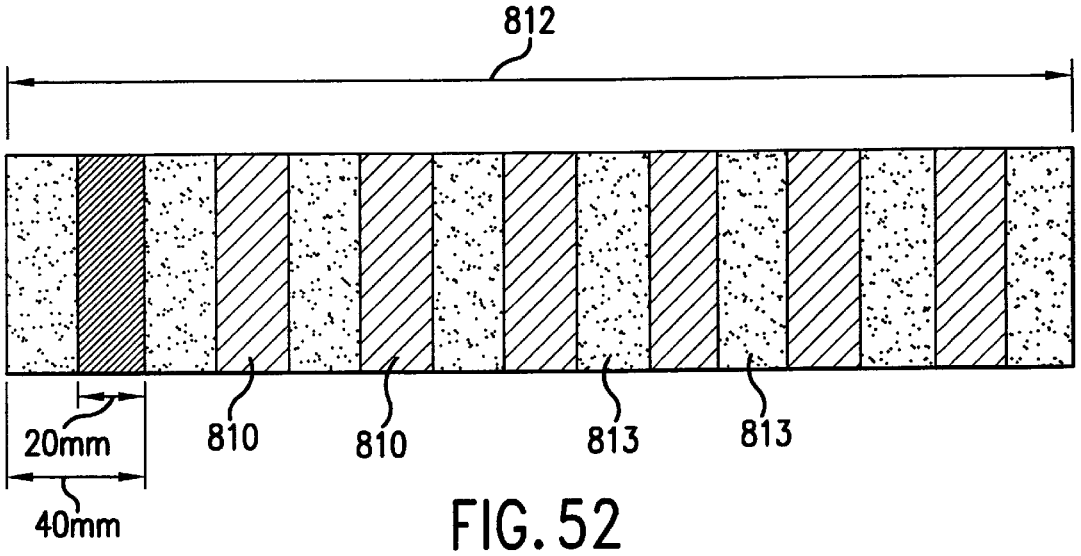

Further, as illustrated in FIG. 52, if a plurality of areas 810 are made of silicon rubber, for example, having traction coefficient of $1.5\mu$, and a plurality of other areas 813 sand-witched by each of the plurality of the areas 810 are made of fluorine plastic, for example, having traction coefficient of $0.5\mu$, the same result is obtained as described above. Obviously, numerous modifications and variations of the present invention are possible in light of the above teachings. It is therefore to be understood that, within the scope of the appended claimed, the invention may be practiced otherwise than as specifically described therein.

What is new and desired to be secured by Letters Patent of the United States is:

1. A fixing apparatus for fixing a toner image on a sheet, comprising:

a heating roller having a heat source therein;

a pressure roller in pressure contact with said heating roller; and a sheet transporting member configured to transport a sheet between said heating roller and pressure roller;

wherein said pressure roller includes a plurality of high traction coefficient areas which are symmetrically disposed on a surface thereof.

2. A fixing apparatus as claimed in claim 1, wherein said plurality of traction coefficient areas are a product of at least one of physical and chemical processes.

3. A fixing apparatus as claimed in claim 2, wherein a center of said surface of said pressure roller is roughened and coated by a thin film.

4. A fixing apparatus as claimed in claim 1, wherein a traction coefficient of said surface varies between two or more levels.

5. A fixing apparatus as claimed in claim 1, wherein a traction coefficient of said surface varies along a width of said pressure roller according to a curved function.

6. A fixing apparatus for fixing a toner image on a sheet, comprising:

a heating roller having a heat source therein;

a pressure roller in pressure contact with said heating roller;

a sheet transporting member configured to transport a sheet between said heating roller and pressure roller;

wherein a surface of said pressure roller includes plurality of pairs of high and low traction coefficient areas which neighbor each other and are arranged along a width of said pressure roller.

7. A fixing apparatus as claimed in claim 6, wherein said plurality of pairs of high and low traction coefficient areas have two different traction coefficients.

8. A sheet feeding apparatus, comprising:

a driving member which rotates at a first speed; and a pressure member for pressure contacting the driving member by rotating at a second speed;

wherein said driving roller or the pressure roller includes a surface having different traction coefficients along a width thereof, and wherein said first speed is substantially larger than said second speed.

9. A sheet feeding apparatus, comprising:

a driving member which rotates at a first speed; and a pressure member for pressure contacting the driving member by rotating at a second speed substantially faster than the first speed;

wherein said driving member and the pressure member respectively includes a surface symmetrically having different traction coefficients representing a prescribed distribution along a width thereof, said surfaces face each other in such a manner that a difference in a value of the coefficients between the surfaces is smallest almost at a center of the width of the members.

10. A sheet feeding apparatus as claimed in claim 9, further comprising:

a release agent applying device for applying release agent onto said surface of said pressure member, and a release agent-collecting member for collecting a part of said release agent from said surface of said pressure member.

11. A sheet feeding apparatus as claimed in claim 9, further comprising:

a lubricant-applying member configured to apply lubricant onto said surface of said pressure member without applying lubricant to a center portion of said surface of said pressure member.

12. A sheet feeding apparatus as claimed in claim 9, said pressure member further comprises grooves provided on said surface of said pressure member, said grooves configured to provide said prescribed distribution.

13. A sheet feeding apparatus as claimed in claim 9, wherein said pressure member is physically or chemically processed, thereby providing said prescribed distribution.

14. A sheet feeding apparatus as claimed in claim 9, wherein a central portion of one of said pressure member and said heating roller further comprises a material having a traction coefficient which is greater than a traction coefficient of material used for adjacent portions of said surface that are adjacent to said central portion.

15. A sheet feeding apparatus as claimed in claim 9, wherein a central portion of said surface of said pressure member further comprises a physically or chemically roughened surface and a film coated thereon, configured to provide said prescribed distribution.

16. A sheet feeding apparatus as claimed in claim 9, wherein a traction coefficient of said surface of said pressure member varies so as to decrease, in a step by step manner, from a center portion of said pressure member towards adjacent portions thereof.

17. A sheet feeding apparatus as claimed in claim 9, wherein a traction coefficient of said surface of said pressure member varies so as to linearly decrease from a center portion of said pressure member towards adjacent portions thereof.

18. A sheet feeding apparatus as claimed in claim 9, wherein a traction coefficient of the surface of said pressure member varies non-linearly and decreases from a center portion of said pressure member towards adjacent portions thereof.

19. A sheet feeding apparatus, as claimed in claim 9, wherein:

said driving member includes an endless sheet feeding belt.

20. A sheet feeding apparatus as claimed in claim 19, further comprising:

a release agent applying device configured to apply a release agent onto said surface of said pressure member, and a release agent-collecting member configured to collect said release agent from a middle portion of said surface of said pressure member.

21. A sheet feeding apparatus as claimed in claim 19, wherein said surface of said pressure member further comprises a release agent provided on adjacent portions of said surface of said pressure member so as to provide a central portion of said pressure member with a traction coefficient that is greater than a traction coefficient of said adjacent portions.

22. A sheet feeding apparatus as claimed in claim 19, wherein said surface of said pressure member further comprises a release agent and wherein a center portion of a surface of said endless belt does not include a release agent so as to provide a traction coefficient at a center portion of said pressure member which is greater than a traction coefficient of adjacent portions of said pressure member.

23. A sheet feeding apparatus as claimed in claim 19, wherein a central portion of said surface of said pressure member is roughened so as to provide a traction coefficient which is greater than a traction coefficient of adjacent portions of said pressure member.

24. A sheet feeding apparatus as claimed in claim 19, wherein a central portion of said surface of said pressure member is roughened as a product of a physical process.

25. A sheet feeding apparatus as claimed in claim 19, wherein said surface of said pressure member further comprises a plurality of grooves.

26. A sheet feeding apparatus as claimed in claim 19, wherein a central portion of said surface of said pressure member is roughened as a product of a chemical process.

27. A sheet feeding apparatus as claimed in claim 19, wherein the traction coefficient along the width of said surface of said pressure member varies so as to decrease from a central portion thereof towards first and second ends of said surface of said pressure member.

28. A sheet feeding apparatus as claimed in claim 19, wherein the traction coefficient along the width of said surface of said pressure member varies so as to linearly decrease from a central portion thereof towards a first and second end of said surface of said pressure member.

29. A sheet feeding apparatus as claimed in claim 19, wherein the traction coefficient along a width of said surface of said pressure member varies non-linearly so as to decrease from a central portion of said surface of said pressure member towards a first and second end of said surface of said pressure member.

30. A sheet feeding apparatus as claimed in claim 19, wherein said surface of said pressure member further comprises a coating material which has a traction coefficient which is greater than a traction coefficient of material comprising adjacent portions of said pressure member.

31. A sheet feeding apparatus as claimed in claim 19, wherein said pressure member is coated by a thin film.

32. A sheet feeding apparatus as claimed in claim 19, wherein said heat source comprises a heating element.

33. A sheet feeding apparatus as claimed in claim 19 further comprising:

a winding member configured to wind said endless belt and press said endless belt against said pressure member.

34. A fixing apparatus for fixing a toner image to a sheet, comprising:

an endless belt configured for fixing a toner image;

a heat roller having a heat source therein, configured for winding and applying heat to said endless belt;

a tension roller configured for winding said endless belt thereon and applying a tension thereto; and a pressure roller disposed in pressure contact with said endless belt, towards said heat roller;

wherein a central portion of a surface of said pressure roller is provided with a traction coefficient which is greater than a traction coefficient of adjacent portions of said surface of said pressure roller which are adjacent to said central portion;

wherein said surface of said pressure roller further comprises a release agent and wherein a center portion of a surface of said endless belt does not include a release agent so as to provide said traction coefficient which is greater than said traction coefficient of said adjacent portions.

* * * * *